US012049718B2

(12) United States Patent
Snyder-Singer

(10) Patent No.: US 12,049,718 B2
(45) Date of Patent: Jul. 30, 2024

(54) APPARATUS AND METHOD FOR CONSTRUCTING A QUILT

(71) Applicant: Jane F. Snyder-Singer, Wilmington, DE (US)

(72) Inventor: Jane F. Snyder-Singer, Wilmington, DE (US)

( * ) Notice: Subject to any disclaimer, the term of this patent is extended or adjusted under 35 U.S.C. 154(b) by 824 days.

(21) Appl. No.: 16/700,328

(22) Filed: Dec. 2, 2019

(65) Prior Publication Data

US 2021/0123175 A1 Apr. 29, 2021

Related U.S. Application Data

(60) Provisional application No. 62/773,307, filed on Nov. 30, 2018.

(51) Int. Cl.
*D05B 97/12* (2006.01)

(52) U.S. Cl.
CPC ..... *D05B 97/12* (2013.01); *D05D 2305/08* (2013.01); *D05D 2305/32* (2013.01)

(58) Field of Classification Search
CPC ..... D05B 97/12; D05D 2305/08; D05D 2305/32; B26D 7/01
See application file for complete search history.

(56) References Cited

U.S. PATENT DOCUMENTS

| | | | | |
|---|---|---|---|---|
| 5,791,062 | A * | 8/1998 | Walker | D05B 97/12 33/565 |
| 6,021,726 | A | 2/2000 | Muraki | |
| 6,101,645 | A | 8/2000 | Hill | |
| 6,696,129 | B1 | 2/2004 | Cotton | |
| 7,730,842 | B1 * | 6/2010 | Sebrow | D06H 7/00 112/475.08 |
| 7,854,073 | B1 * | 12/2010 | Webb | D05B 97/12 33/1 G |
| 8,186,072 | B1 * | 5/2012 | Nethery | D05B 97/12 33/565 |
| 8,353,250 | B2 | 1/2013 | Preston | |
| 2009/0113737 | A1 * | 5/2009 | Graham | D05B 97/12 33/562 |
| 2012/0204437 | A1 * | 8/2012 | Nethery | B43L 7/027 33/566 |
| 2014/0283722 | A1 | 9/2014 | Pinoli | |

* cited by examiner

*Primary Examiner* — Nathan E Durham
(74) *Attorney, Agent, or Firm* — Woods Oviatt Gilman LLP; Dennis B. Danella, Esq.

(57) ABSTRACT

Systems, devices and methods for constructing a quilt from a plurality of quilt blocks are described herein. The devices include a flat body having a front planar surface and a rear planar surface that contacts a fabric when in use, the flat body including: a back/sash template for measuring and cutting a back piece of each quilt block; and a centering guide for indicating where quilt blocks in different rows of the quilt will align.

17 Claims, 36 Drawing Sheets

The piece of textile intended to be featured in the quilt

APPARATUS AND METHOD FOR CONSTRUCTING A QUILT

CROSS-REFERENCE

This application claims the benefit of U.S. Provisional Patent Application No. 62/773,307, filed Nov. 30, 2018, and the entire contents of U.S. Provisional Patent Application No. 62/773,307 is hereby incorporated by reference.

TECHNICAL FIELD

The embodiments disclosed herein relate to apparatuses and methods for constructing layered textiles and specifically to apparatuses and methods for constructing quilts using fabrics.

BACKGROUND

Sometimes people who are not skilled in the art of quilt making wish to make a commemorative quilt. Often they intend to use "feature fabrics" which are pieces of cloth (often sentimental) such as old t-shirts, baby clothes or even a combination of small pieces of fabric sewn together. Without additional processing, these fabrics are usually unsuitable for quilts as they frequently have low-intrafabric stability by structure. Knits and t-shirt material are examples of fabrics with low-intrafabric stability. Fabrics vary in their inherent ability to stretch. Woven fabric typically stretches little (high-intrafabric stability), while knitted fabric typically stretches much more than a woven fabric (low intrafabric stability). We will refer to this ability for a fabric to stretch as "intrafabric stability" i.e. the ability of a fabric to be displaced relative to itself.

Occasionally, woven fabrics, which would normally be considered to have high intrafabric stability, may be unsuitable for quilt making because the pieces are so small they cannot be cut following a grain line, or they have deteriorated due to age. The most widely accepted way to control the undesirable characteristics of low-intrafabric stability when using them in a quilt is to apply a woven fusible "stabilizer" to reduce instability and fabric distortion. Products falling into the woven fusible category are currently costly (averaging two to three times the cost of material sold for quilt fabric because they are sold in widths ½ of the width of the average fabric). The stiffness introduced when using multiple layers of fusible stabilizer, as well as extra time and cost often makes it undesirable to do anything with the undecorated area of the sentimental textile but discard it.

Commemorative quilts typically are constructed after a collection of feature fabric can be acquired. This can take years. Keeping track of all that material can discourage a person from making a commemorative quilt. Quilting, by definition, involves the stitching together of multiple layers of fabric. The layers must be kept horizontally registered while stitching for a desirable outcome. However, the process of stitching itself causes layers to slide relative to each other. We refer to this tendency as "interfabric stability" i.e. the tendency of a layer of fabric to be displaced relative to another layer.

Quilts can vary in size. Only a small portion of a large quilt can be sewn at one time without special equipment, and this area will be defined as the "working area" of a quilt.

Interfabric stability is significantly impacted, particularly when using a fabric with a low degree of intrafabric stability, by the weight of any fabric outside the working area when the quilt is not constrained by a mechanism that reduces the force of gravity on the layers of the quilt in the working area. Once stitches are applied to the working area they will maintain any distortion that may have been caused by the impact of gravity and the pulling of any parts of the quilt not constrained during the application of stitches. Hand-basting and pinning are the most frequently used methods of maintaining interfabric stability in the working area of a quilt. These methods require a lot of time. Hoops may also be used to maintain interfabric stability between quilt layers but it is difficult to install all of the layers of a quilt into a hoop, and this method requires frequent repositioning of the hoop.

"Pad stitching" refers to stitches positioned through and permanently holding all layers of material in a quilt together. Pad stitching is visible, can be decorative and is used to promote interfabric stability during regular use and washing of a quilt. There are three basic methods of pad stitching. "Pad-stitching by hand" is the easiest to demonstrate and understand but it is difficult for beginners to produce attractive results and the most time-consuming way to address interfabric instability. Another method of pad stitching is done using a sewing machine, with stitches applied without constraints on the fabric. This pad stitching, which will be labeled "machine pad-stitching," maintains interfabric stability by use of a mechanism known as a walking foot, which coordinates the movement of the top layer of fabric with the lower layer. This way of pad-stitching is intended to sew straight lines or gentle curves. It produces the best results when the quilt layers are supported in the working area by means of expansion of the "machine bed" (the area of a home sewing machine that supports the fabric as it is sewn). To reduce the impact of gravity on the working area a device known as an extension table may be installed. The cost of an extension table and walking foot, as well as the limited pathway of stitches, may discourage an incidental quilt maker from choosing this method of pad-stitching.

"Stippling," a more fluid way of pad stitching using a home sewing machine, is done by disengaging the sewing machine's lower feed mechanism and moving the fabric by hand underneath the needle of the sewing machine as stitches are formed. When stippling the pressure mechanism that usually holds the fabric on the machine bed (the pressure foot) is either discarded or replaced with a foot that does not apply constant downward pressure on the fabric as it is sewn. When using a general purpose, household sewing machine, stippling is fast, accessible, easy to learn, and, if the stitches follow a free-form path, is difficult to do incorrectly. A challenge to stippling using a household machine relates to problems with moving layers of a very large project while trying to maintain intrafabric stability. With large quilts there is a lot of material hanging off the bed of a household sewing machine which could be pulled out of alignment and even distort the area of the quilt in the working area. Some methods of making a quilt explored by a casual quiltmaker require that individual quilt blocks be joined by hand-stitching. This is rarely fast and often produces an unsatisfactory result in terms of appearance since takes a lot of practice to produce stitches of consistent width and distance.

Casual quilt makers who wish to make a commemorative quilt will often construct the front and then find a company or person with a quilting business to install the back. This adds an additional cost ranging on one website from $75.00 to $100.00 for a 5'×7' quilt.

Accordingly, there is a need for new or improved systems and methods of constructing quilts.

SUMMARY

Systems, methods and devices for constructing a quilt from a plurality of quilt blocks are described herein.

According to one broad aspect, a device for constructing a quilt from a plurality of quilt blocks is described herein. The device includes a flat body having a front planar surface and a rear planar surface that contacts a fabric when in use, the flat body including: a back/sash template for measuring and cutting a back piece of each quilt block; and a centering guide for indicating where quilt blocks in different rows of the quilt will align.

In some embodiments, the centering guide includes a joining guide positioned along a center axis of the device.

In some embodiments, the joining guide includes two or more apertures of equal size.

In some embodiments, the apertures are spaced apart from each other by a distance in a range of about 0.02 inches to about 0.5 inches apart.

In some embodiments, the two or more apertures include a top dot for installing marks indicating the beginning and end of stitch lines when joining two or more of the quilt blocks together.

In some embodiments, the top dot is positioned on the device to align quilt blocks with one another.

In some embodiments, the joining guide includes five apertures aligned along the center axis of the device.

In some embodiments, the centering guide includes centering placement guides positioned on either side of the joining guides.

In some embodiments, the centering placement guides include a first group of centering placement guides and a second group of centering placement guides, the first group and the second group being positioned on opposite sides of a center axis of the device.

In some embodiments, each centering placement guide of the first group of centering placement guides has a corresponding centering placement guide in the second group of centering placement guides.

In some embodiments, the first group of centering placement guides includes a plurality of line segments, each line segment being positioned in a range of about 0.02 inches to about 0.75 inches apart from a neighboring line segment.

In some embodiments, the second group of centering placement guides includes a plurality of line segments, each line segment being positioned in a range of about 0.02 inches to about 0.75 inches apart from a neighboring line segment.

In some embodiments, the centering guide is positioned towards in an upper portion of the device.

In some embodiments, the device also includes a coordinating stabilizer template for measuring and cutting a stabilizer piece for inserting into each quilt block.

In some embodiments, the device also includes stitch placement guides that indicate where stitches will be placed to join the quilt blocks to one another.

In some embodiments, the stitch placement guides are dashed lines.

In some embodiments, the device also includes channels to provide for marking stitching lines on the fabric.

In some embodiments, each of the quilt blocks has an equiangular shape.

In some embodiments, each of the quilt blocks has a same equiangular shape.

According to another broad aspect, a method of constructing a quilt from from a plurality of quilt blocks is described herein. The method includes using a device for constructing a quilt from a plurality of quilt blocks as described herein.

In some embodiments, a set of templates to determine and/or cut and the parts used to make the back of quilt blocks is described herein. It has a centering guide to help join the quilt blocks together with a sewing machine and requires minimal hand-sewing. Much of the sewing is internal, so many stitches will not be visible when the quilt is complete, making it easier to hide any stitching inconsistencies.

In some embodiments, the present disclosure addresses problems encountered when using fabrics with low-intrafabric stability to construct a quilt by stabilizing the back of the quilt as opposed to the traditional approach of stabilizing the front of the quilt. In this disclosure, if the front of the quilt requires stabilization, it will be addressed by stippling.

Because only the back of each quilt block requires stabilization, the methods described herein generally do not add any significant time when constructing a quilt using fabrics with low-intrafabric stability for both the front and the back of the quilt.

Because the back fabric is stabilized, fabric that was previously considered unsuitable for a quilt back and discarded (such as the back of t-shirts) is available for constructing the back of a quilt block. This saves money and time shopping for coordinating textiles to use when making the quilt-back.

In some embodiments, methods described herein provide a way to install new quilt blocks as feature fabrics are acquired. A quilt can be "finished," and with the removal of a few stitches per block; more quilt blocks can be sewn to the existing quilt without any distinct inconsistencies in the quilt.

In some embodiments, the systems, methods and devices described herein address problems with interfabric stability when pad-stitching. Because the quilt blocks are relatively small, and because the stabilized back acts like an extension table to reduce the impact of gravity on each quilt block, the installation of pad-stitching is simplified.

In some embodiments, the systems, methods and devices described herein install the back of the quilt as part of the process of making a quilt block, eliminating the need for professional assistance to complete a quilt. Using the methods described herein, as the quilt backs are constructed, they are lined by the stabilizer.

In some embodiments, the back/sash template and coordinating stabilizer templates described herein are designed to work together to introduce favoring and eliminate the possibility of the lining/stabilizer being visible when the quilt is complete. In this present disclosure, favoring is automatic, and no trimming or easing is required.

In some embodiments, because the devices described herein use a centering guide to indicate where the quilt blocks will align (as opposed to the traditional method of using the edge of fabric) the quilt can be made with quilt blocks alternating between front-up and front-down, producing a reversible quilt. An alternative reversible quilt can be made by substituting a featured fabric for the back/sash part of the quilt and using one for the front as well.

In some embodiments, the present disclosure provides for fabric to be left at the tip of the beveled edge, eliminating trimming of the point, and allowing the layers of the quilt to be flat after construction with no weakening of a seam. Leaving the fabric at the tip of the beveled edge is important because it anticipates a quilt maker will expose the tip of the beveled edge if they wish to add more blocks to a "finished" quilt.

In some embodiments, the centering guide provides an opportunity to install multiple marks which direct the placement of temporary stays (e.g., basting or pins) when joining quilt blocks to one another. On certain applications using more than one mark to position temporary stays results in more uniform appearing sashes in the finished quilt. The multiple temporary stays accomplish this by guiding the quilt maker to join quilt blocks to one another without lining up the long edges of the quilt blocks when they are sewn together. Using long edges to align quilt blocks is a problem because inconsistencies in quilt blocks' shapes often lead to pulling or coaxing extra material away from the long edges of quilt blocks as a quilt maker aligns one quilt block's long edges to the long edges of another quilt block. When fabric of the quilt block is manipulated as described the unsewn portion of the quilt blocks being joined together becomes distorted. Small inconsistencies are compounded as more quilt blocks are added. Temporarily holding the quilt blocks together along the center of a beveled edge reduces pulling and distortion of the parts of the quilt block which are not being sewn together. Using this technique also provides an opportunity to install quilt blocks with different width sashes in the same quilt.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Figure 1:
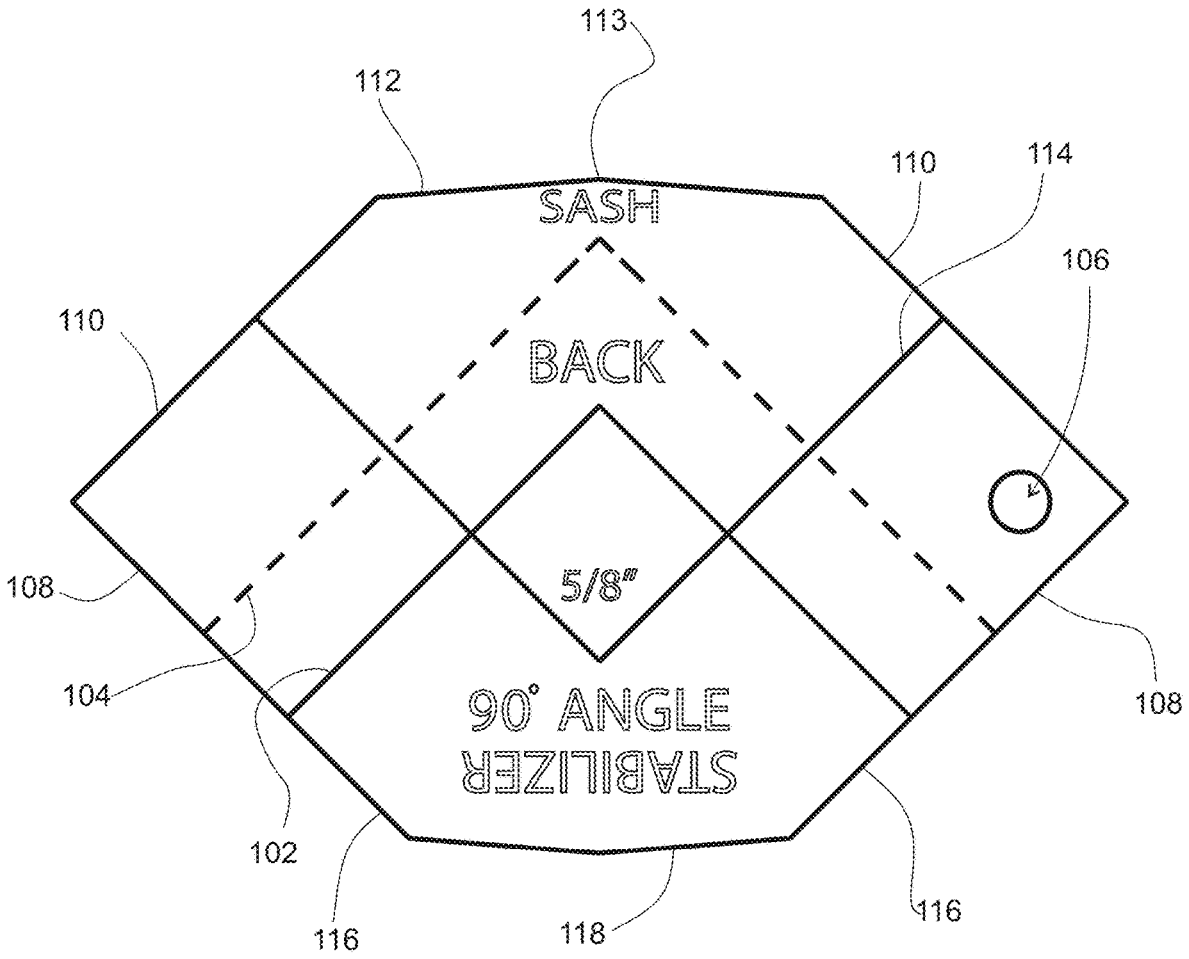
FIG. 1 is the top view of a template that combines the back/sash template with the stabilizer template. It is used when featured fabrics are outlined with equiangular rectangles and will produce sashes that are ⅝" wide.

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment", "the embodiments", "one or more embodiments", "some embodiments", and "one embodiment" mean "one or more (but not all) embodiments of the present invention(s)", unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

The present disclosure describes that the sash/back of a quilt block is lined with a stabilizing material and turned right side out. Unless a quilt maker anticipates this procedure, the lining/stabilizing material will be pulled toward the front and visible after construction. This is a problem because it results in the construction of the quilt appearing sloppy. The tendency for a lining to pull to the outside of a product can be addressed by favoring the back/sash piece of fabric. Favoring, in its recognized form, requires extra work (e.g. trimming and easing). When fabric is sewn to form a beveled edge it is a common practice to cut and remove fabric at the tip of the bevel to permit the completed seam to lay flat. This extra step causes a weakness in the part of the seam where the fabric is removed.

Herein, a "quilt block" refers to a single part of a quilt that includes a front and a back and, frequently, batting therebetween. Quilt blocks are joined together to form a quilt.

Herein, the term "equiangular" describes a form or shape having all equal angles.

Herein, the term "initial geometry" describes an equiangular shape that is chosen to be the desired shape of a quilt block.

Herein, when line segments meet at an angle, and are copied and offset, any line outer points that are positioned perpendicular to the intersection of line segments forming said angle are designated "LAP."

Further to the above, the term "initial angle" is a small portion of the initial geometry that includes two line segments measuring between ¼" and 24" long, meeting at an intersection that forms an angle equal to the initial geometry's angles.

"Line outer points" are the ends of line segments that are not intersecting any other line segment to form an angle. "Outer geometry" describes any area where line segments that meet at an angle are copied and positioned parallel to said angle. If the copied line segments were continued to the intersection of one another, and the resulting lines segments would be longer than the ones copied, they are positioned in the outer geometry.

"Inner geometry" describes any area where line segments that meet at an angle are copied and positioned parallel to said angle. If the copied line segments were reduced to the intersection of one another, and the resulting lines segments would be shorter than the ones copied, they are positioned in the inner geometry.

For the purposes of this disclosure, any line outer points that, after being offset, are positioned perpendicular to the intersection of line segments forming said angle are designated "LAP."

A "beveled angle" describes two line segments of equal length that intersect at an angle which is determined by doubling the degrees of the initial angle and using this result to determine the angle line segments meet to form the beveled angle (e.g., a sixty-degree initial angle would have a beveled angle of one-hundred twenty degrees).

A "beveled edge" is the shape formed by one or two lines segments which bridge two line segments at their LAPs. Herein, the beveled edge will be determined by altering the beveled angle in the following ways:

1) If the beveled angle is a straight line it will become a slight angle. Using a horizontally positioned beveled angle, locate the center of the line, (or the intersection of the line segments) and place a point "P" perpendicular to the center and above the center of the line. The distance the "P" is placed above the center can vary by 0.02" to 0.5" and is determined by the thickness of the material used to make the quilt blocks. The beveled edge is established by attaching the line outer points of the beveled angle (in this case the beveled angle is a straight line) to "P."

2) If the beveled angle is derived from a triangle a beveled edge is formed by positioning a new point or "P" in the outer geometry of the beveled angle. Point P is positioned along an imaginary line that bisects and extends past the intersection of the beveled angle into the outer geometry. The distance point P is positioned from the intersection of the beveled angle can vary by 0.02" to 0.5" and is determined by the thickness of the material used to make the quilt blocks. The beveled edge is established by attaching to the line outer points of the beveled angle to point "P".

3) If the beveled angle is not derived from a triangle a beveled edge is formed by positioning a new point or "P" in the inner geometry of the beveled angle. Point P is positioned along an imaginary line that bisects the beveled angle. The distance new point P is positioned from the intersection of the beveled angle can vary by 0.02" to 0.5" and is determined by the thickness of the material used to make the quilt blocks. The beveled edge is established by attaching the line outer points of the beveled angle to point "P".

When material for the quilt back is cut, beveled edge refers to the part of the cut goods which was derived from the beveled edges of templates.

The "Back" is the part of the quilt block that is positioned on the side opposite the sash. A "Sash" is a portion of the fabric cut using the back/sash template which is wrapped from the back of the quilt to the front of the quilt as the quilt blocks are sewn to one another and frames the feature fabric when a quilt block is complete. The side of the quilt with the sash visible is considered the quilt's front.

"Fold absorption" describes when fabric is that is folded a small amount at the crease (from 0.02" to 0.5" of the fabric) is absorbed by the process of folding the fabric and any stitches installed in the folded area of the fabric. The amount of fabric absorbed by folding the fabric is determined and will vary by the weight and stiffness of the fabric being folded.

"Favoring allowance" is a small amount of material (between 0.02"-0.5", and determined by the fabric's weight and stiffness) which is anticipated and pulled, during the construction of a fabric product, towards the wrong side of the product to ensure that no stitching lines, facings, or linings will be visible on the right side of the finished product.

"Depth of back/sash" is the sum of two times the sash width plus seam allowance width plus favoring allowance plus the fold absorption amount.

"Depth of stabilizer" is two times the sash width plus seam allowance, minus any favoring allowance.

A "cutting edge" is the edge of a template used to guide the quilt maker when cutting or tracing a shape needed for constructing the parts of a quilt block's back/sash.

"Templates" are pieces of rigid material (such as acrylic) from 1/16" to 3/8" thick that are cut in a specific shape and can be repeatedly traced or rotary-cut without altering the shape of the template.

A "centering guide" is a guide made of transparent material and is not subject to ripping or wrinkling. A centering guide is used to mark top dots and joining guides which are used to temporarily align and stay quilt blocks as they are joined to one another.

A "back/sash template" is a guide used to determine the size and shape of the material used to make a quilt block's back and the sash. Each back/sash template is designed to prepare fabric to make a quilt block with a specific sash width and coordinates with a stabilizer template.

A "stabilizer template" is a guide to create the shape of a stabilizing material used to line and control the quilt back/sash and finish a quilt block's sash edges. Stabilizer templates are limited to one sash width (if a different sash width is required a different stabilizer template is required) and coordinate with a back/sash template.

"Top Dot" describes a method of indicating the meeting of the intersection of two line segments that meet at an angle equal to the initial angle. In this method of constructing a quilt the top dots' location must be transferred to the fabric.

When required for clarity in this specification, the long edges of the quilt block are differentiated assigned letters to each side as follows: With the quilt block front-side up (so the featured fabric is visible) the edge of the quilt block below the narrowest portion of the heart is labeled "B." Moving clockwise the next side is designated "S." Continuing in a clockwise motion the part of the quilt block considered above the top of the heart is labeled "J." The remaining long edge is labeled "D 912 & 914."

Figure 2:
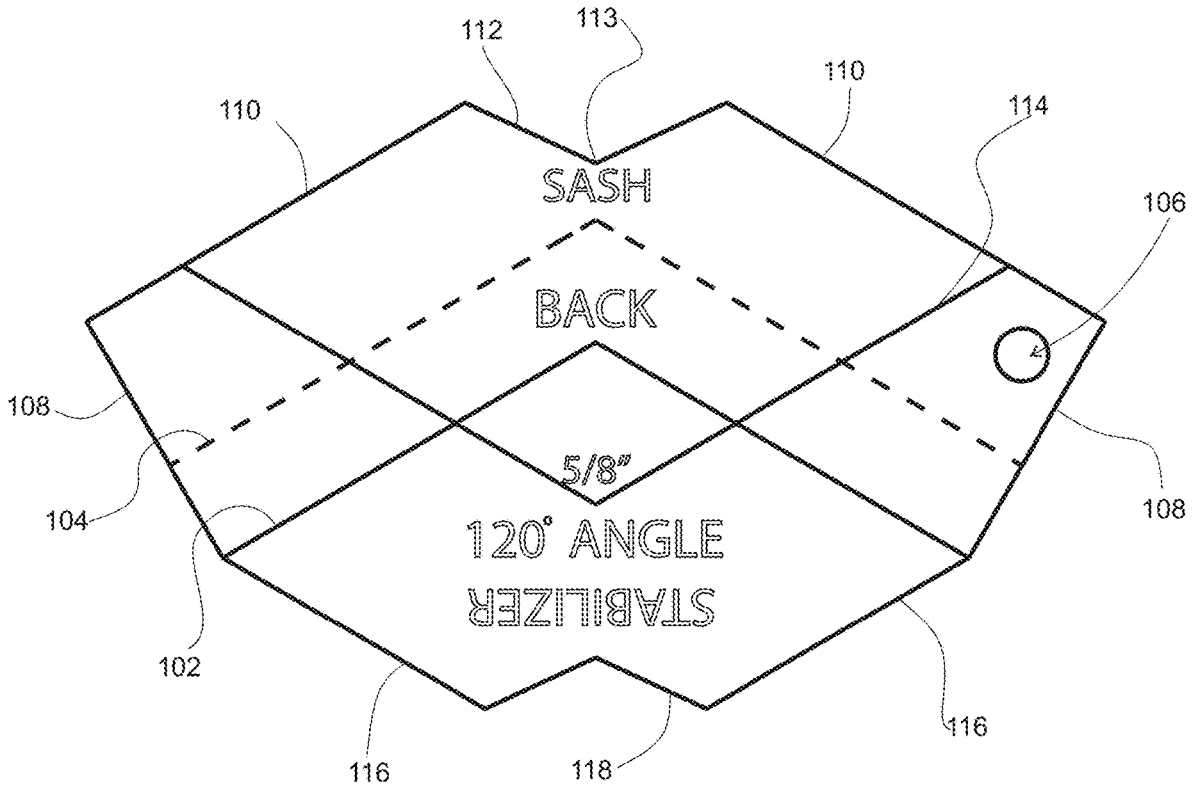
FIG. 2 is the top view of a template that combines the back/sash template with the stabilizer template. It is used when featured fabrics are outlined with equiangular hexagons and will produce sashes that are ⅝" wide.

Turning to the FIGs, one embodiment of the template for a quilt block with a 5/8" sash width is shown in FIGS. 1 and 2. The templates pictured in FIG. 1 and FIG. 2 are combination templates that include the back/sash template and the coordinating stabilizer template in one unit. FIG. 1 illustrates a template designed to make equiangular quilt blocks with ninety degree angles. Dashed lines 104 are stitch-placement guides and indicate where stitches will be placed to join quilt blocks to one another when forming a quilt.

FIG. 2 illustrates a template to make equiangular quilt blocks with 120-degree angles. The templates are formed using transparent or translucent plastic such as acrylic. A template can be anywhere from 1/16 to 1/4" thick and is relatively rigid. The centering guides (see FIG. 6 & FIG. 7) can be made of a transparent material ha can be as thin as a 4 mil transparency film to 3/4" thick material.

Angle 102 (FIG. 1) is a duplicate of the initial angle. Angle 102 is a guide used to position the template onto the fabric to form the back/sash part of the quilt. 106 is a hole drilled for hanging the template. Lines 108 begin at the line outer points of and are perpendicular to angle 102. The length of 108 equals the depth of back/sash. Lines 110 are copies of the line segments that intersect to form angle 102. The copied line segments are offset in the outer geometry of angle 102 a distance equaling the depth of back/sash, Lines 110 are considered the long edges of the quilt block and are offset to intersect line segment 108 at right angles, Line segments 110 are reduced in length starting at their LAPs by an amount between 0.02' and 0.375" with the amount of the reduction being determined by the favoring allowance, Altered ends of line segments 110 that do not intersect line 108 are still considered LAPs.

Angle 112 is a beveled edge derived from the initial angles used to establish angle 102, 113 indicates the position of point "P" on the beveled angle.

Lines 110 combined with angle 112 form the cutting edge of the back/sash template and are guides for tracing or rotary cutting. Angle 114 is a copy of the initial angle and the guide used to position this template onto a stabilizer when tracing or rotary cutting the stabilizing layer of material. Lines 116 are copies of the line segments that intersect to form angle 114. The copied line segments are offset in the outer geometry of angle 114 a distance equaling the depth of stabilizer. Lines 116 are shortened at their LAPs an amount equal to that taken away from line 110 at its LAP. Altered ends of line segments 116 that do not intersect angle 102 are still considered LAPs. Lines segments 116 are shortened to intersect angle 102 at the end points not considered LAPs. Lines 116 are considered the long edges of the stabilizer. Angle 118 bridges the shortened LAP points of lines 116, The angle of the line segments forming angle 118 mimic and mirror the angle made by the intersection of line 110 to angle 112. [Line segments 116 plus angle 118 form the cutting edge of the quilt stabilizer part of the template.

FIG. 2 shows a template made for 120-degree initial angles (equiangular hexagons). All the descriptions for FIG. 1 work for FIG. 2 and any equiangular shape.

Figure 3:
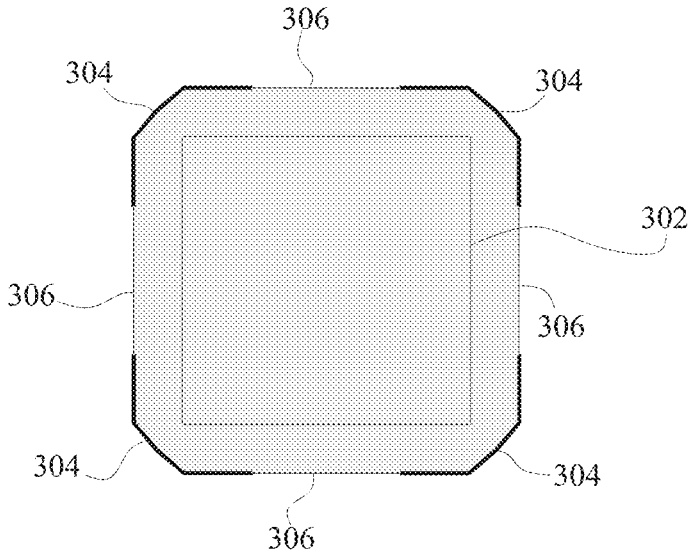
FIG. 3 is a top view of material cut using the back/sash portion of the combination template for rectangles with ⅝" sashes.

FIG. 3 shows orientation of the templates in the method of constructing quilt blocks. The method is illustrated using a combination template and centering guide for right-angle rectangles. The same method applies to any equiangular shape. Use an equiangular shape to surround the portion of the feature fabric to be installed in a quilt block. Copy the shape used to outline the featured fabric onto a piece of fabric intended for the quilt back 302 and a piece of woven stabilizer FIG. 4, 402. Use a template with an initial angle on the template FIG. 1, 102 that duplicates the angles of the shape surrounding the featured fabric and copied to the back fabric and the stabilizer.

Position line FIG. 1, 102 of a template so it matches one the angles of the shape reproduced on the back fabric of the quilt with the words "sash and back" positioned in the outer geometry of the equiangular shape copied to the back fabric. Trace or rotary-cut the cutting edge (lines 110 plus angle 112). Move the template to every angle of the shape derived from the featured fabric and copied to the back fabric. When the template is positioned at each angle as previously described, cut or trace the cutting edge 110, 112. After all the angles are established on the back material, use a straight edge to draw or cut lines in the outer geometry and parallel to the shape copied from the featured fabric connecting the cutting lines' outer points to one another.

Refer to FIG. 3 to see the result of tracing and/or cutting the back fabric as described for a square. In FIG. 3, 302 represents the equiangular shape that was copied from the border of the featured fabric to the back fabric.

In FIG. 3, 304 represents the cutting edges positioned and traced/cut using the template. 306 Represents the lines joining the cutting edges' outer points to one another. Position line 114 of a template so it matches one the angles of the shape reproduced on the woven stabilizer with the word "stabilizer" positioned in the outer geometry of the equiangular shape copied from the featured fabric to the woven stabilizer.

Trace or rotary-cut the cutting edge (FIG. 1, 116, 118). Move the template to every angle of the shape duplicating the one drawn on the featured fabric and copied to the stabilizer. As the template is positioned at each angle as previously described, cut or trace the cutting edge 116, 118. Using a straightedge, draw or cut lines in the outer geometry and parallel to the shape copied onto the stabilizer connecting the cutting lines' outer points to one another.

Figure 4:
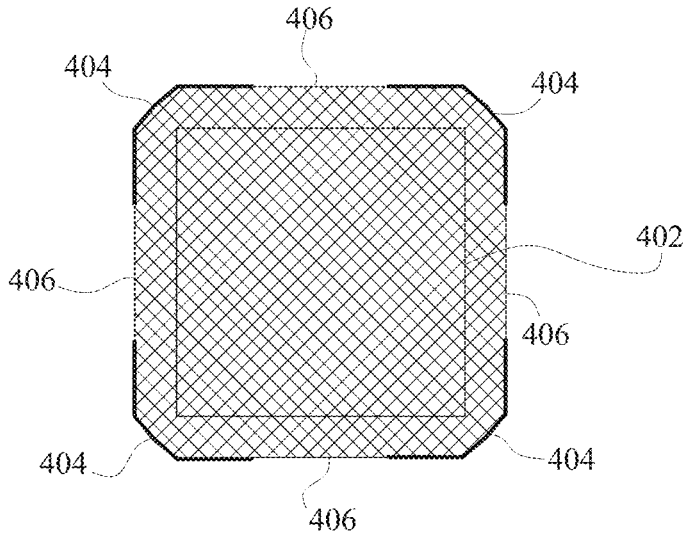
FIG. 4 is the top view of the wrong side of the stabilizer material cut using the stabilizer side of a combination template with ⅝" sashes. The fusible side of the stabilizer is shown face-up.

FIG. 4 illustrates the piece of stabilizer cut using the template with the fusing agent or wrong side facing up. 402 represents the equiangular shape copied from the featured fabric to the stabilizer. The areas labeled 404 represent the template's cutting edges. 406 indicates the places lines were added to join the line outer points of the cutting edges to one another.

Figure 5A:
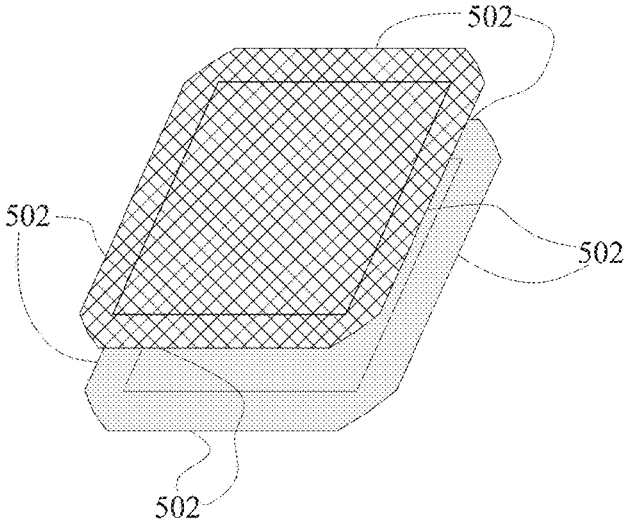
FIGS. 5A to 5C illustrate the procedure used to sew the stabilizer to the back/sash fabric.
Figure 5B:
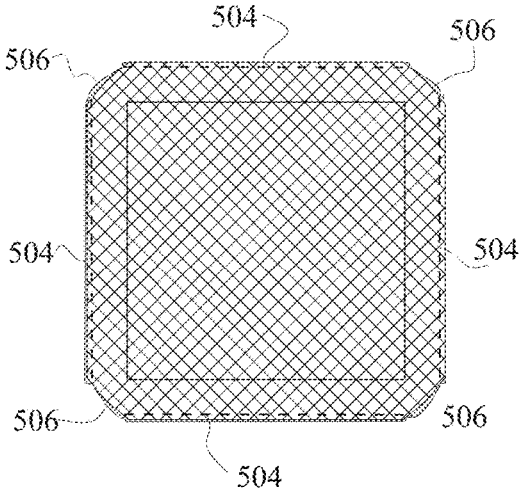
Figure 5C:
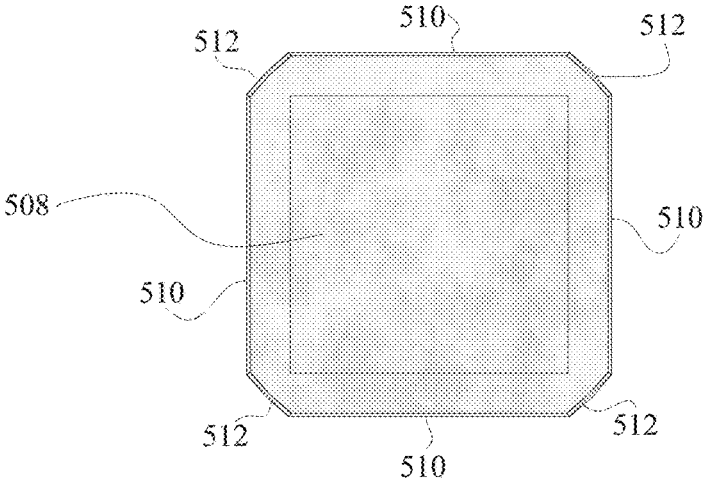

Take the stabilizer and quilt back/sash material cut according to the template, place them right sides together (the fusing agent is on the wrong side of the stabilizer) match long edges FIG. 5, 502 and sew them together along the long edges leaving the beveled edges open. 504. Flatten the seam allowances by hand pressing, pressing or under-stitching. This process is illustrated in 502, which indicates the long edges of the materials cut with the template. 504 indicates the stitching lines joining the back/sash to the stabilizer. Since the back/sash piece is larger than the stabilizer there is some extra fabric causing gaps at the beveled edges 506.

Pull the back/sash and stabilizer through one of the open beveled edges, positioning the fusing agent of the stabilizer next to the wrong side of the back/sash fabric, and press. This favors and finishes the long edges of the sash. 508 shows the right side of the fusible stabilizer.

After the quilt block's back/sash is pulled right side out the long edges of the quilt block is lined 510 but the beveled edges are still open and unfinished 512.

Figure 6:
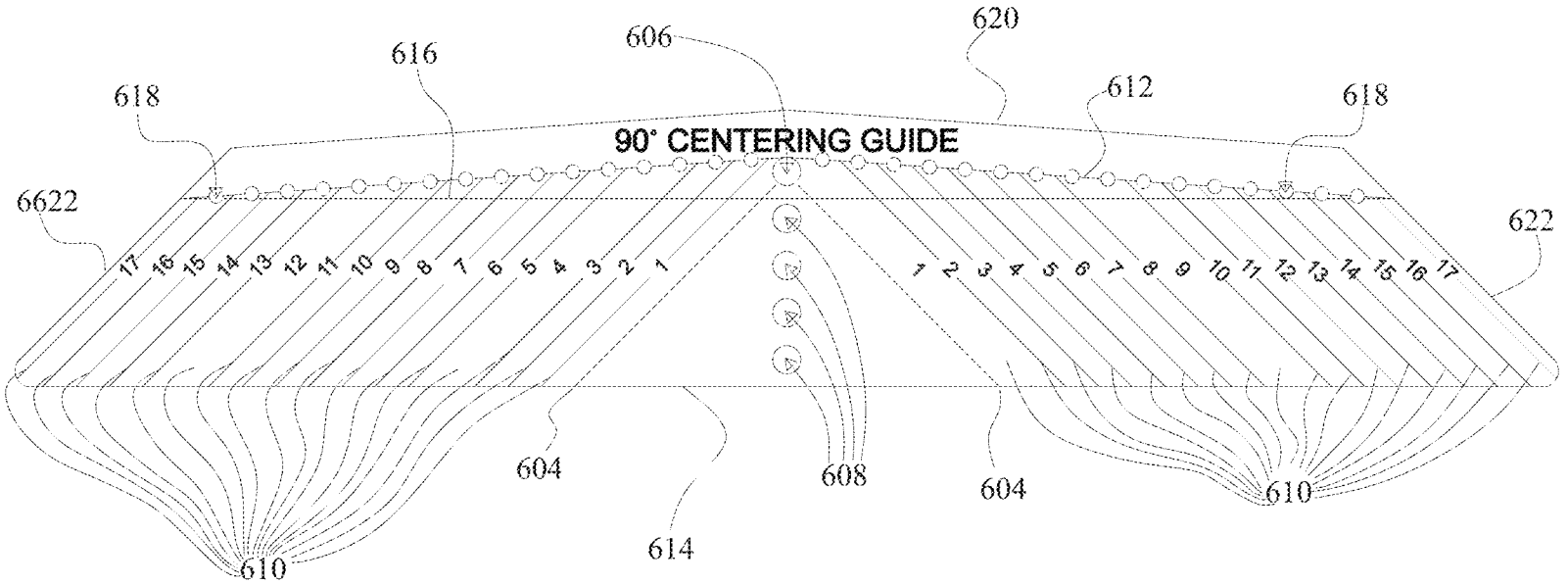
FIG. 6 shows a front view of the centering guide for quilts that are made using equiangular rectangular quilt blocks.
Figure 7:
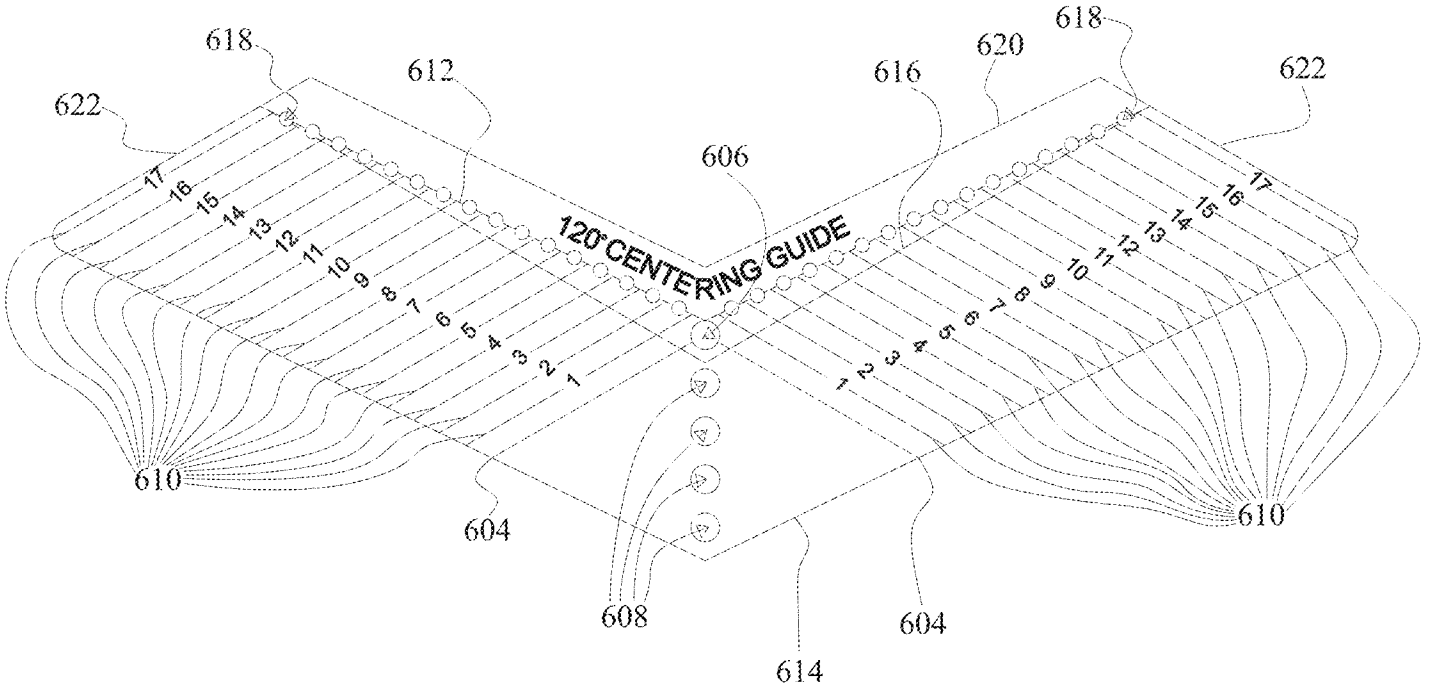
FIG. 7 is a front view of a centering guide used to make quilts using an equiangular, hexagon-shaped template.

FIGS. 6 and 7 each show one embodiment centering guides. Centering guides are designed for a specific angle. The two centering guides pictured are labelled at the top to identify the angle. FIG. 6 is for a 90-degree angle and FIG. 7 is for a 120-degree angle. They can be made from any durable transparent material that will not wrinkle or tear such as acrylic or thin plastic. They can be as thin as a sheet of paper (4.5 ml. to ⅜" thick). One centering guide can be used with templates of many sash-widths if the initial angle is the same. The centering guides pictured are just two examples of possible centering guides that could be made following the directions above.

A centering guide for any equiangular shape can be made following the description for the 90-degree angle centering guide. Since the same description applies to a centering guide made for a 120-degree angle as a 90-degree angle the centering guide FIG. 7 is labeled using the same numbers as the one pictured in FIG. 6. Line segments FIG. 6, 604 are line segments that intersect to duplicate the initial angle. They indicate stitching lines used to join the quilt blocks to one another. 606 indicates an opening in the guide at the intersection of line segments 604 considered the top dot. 608 indicates plurality of openings installed in the inner geometry of the initial angle which are positioned so they bisect the initial angle. They are considered joining guides. 610 indicates a plurality of lines radiating from the line segments of angle 604 in the outer geometry of lines 604. The radiating line segments are placement guides. Each placement guide is related to its mirror image on the other side of the joining guides and this relationship must be apparent. One way to highlight the relationship is to number each line, and because this drawing is black and white, numbering was used but the product under consideration for patent uses a system of colored lines to indicate the relationship. Lines 610 may vary in length from each other and can measure in length from ¼" to 4." Lines 610 are parallel to one another and line segments 604. The number of lines 610 per centering guide is determined by their distance from one another and the depth of the sash required for the quilt block. In FIG. 6 and FIG. 7 the placement lines are positioned ⅛" from each other and could be used with sash depths from ¼" deep to 2" deep. Lines 610 intersect the lower edge 614 and angle 612. Angle 612 is a beveled edge which is derived from the initial angle in position 604 on each centering guide. It is drawn with broken lines to indicate it is the stitching line for sewing the beveled edges of the quilt unit. The beveled edge is situated so the intersection of line segments forming said angle are positioned above the top dot by an amount determined by favoring allowance. The line outer points of angle 612 are positioned so a line drawn connecting them would be perpendicular to a line drawn through the centers of the joining guides. If the initial angle used to derive beveled edge 612 is 90 degrees or less the line end points of angle 612 will be positioned so they fall closest to the lower edge or 614 of the centering guide FIG. 600, 612. If the initial angle used to derive beveled edge 612 is greater than 90 degrees, the line end points of angle 612 will be positioned so they fall as far as possible from lower edge or 614 of the centering guide FIG. 7, 612.

Figure 8:
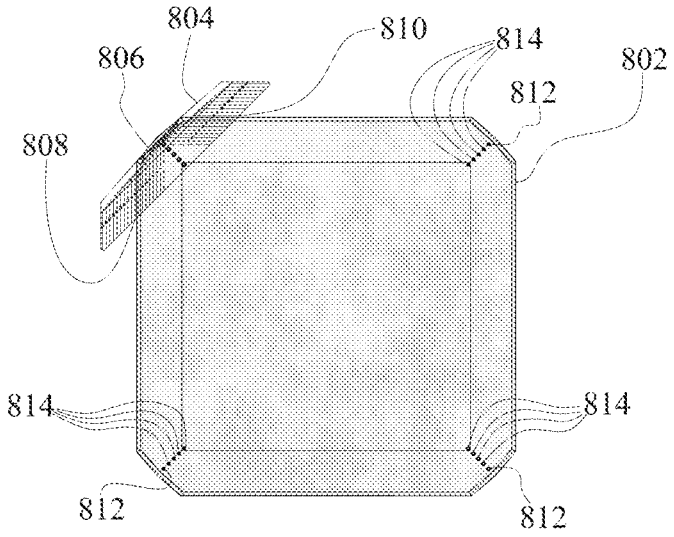
FIG. 8 is an illustration of the stabilized side of a quilt back/sash unit showing the positioning and use of the centering guide at one beveled edge of a ninety-degree equiangular shape.

Line or angle FIG. 6, 614 is the lower edge of the centering guide. It is positions at least 1" from angle 612. All lines 610 intersect 614. Line or angle 616 is a representation of the beveled angle and is installed so the centering guides can have a more general application when determining the center of angles without consideration for fold allowance or allowance for untrimmed beveled edges. 618 marks one of a plurality of holes placed along angle 612 to permit marking stitching lines. These opening are added for convenience. 620 is placed a distance equal to the seam allowance away from angle 612. Line 620 is placed on the raw edges of a quilt block's beveled edge when marking the joining guides. Lines 622 are the sides of the centering guide and are any convenient shape (often, they parallel lines 610). Use a centering guide with the initial angle 604 that matches the template's initial angle FIG. 1, 102 to mark joining guides on stabilized quilt back/sash FIG. 8. The centering guide FIG. 8, 804 is positioned so that the joining guides are in the inner geometry of the stabilized quilt back. The top of the centering guide 620 is positioned as close to the raw edges of the beveled edge of the stabilized quilt back as possible 806.

The position of the centering guide is shifted as needed to ensure that the coordinating placement guides are positioned the same distance from the long edges of the stabilized quilt back they parallel. In other words, placement guide FIG. 8, 808 on the left of joining guides should be about the same distance from a long edge as placement guide 810 on the right side of the joining guides. With the centering guide positioned as previously described mark the top dot 812 for reversible quilts made by alternating the quilt blocks front up and front down FIG. 10.

Figure 12A:
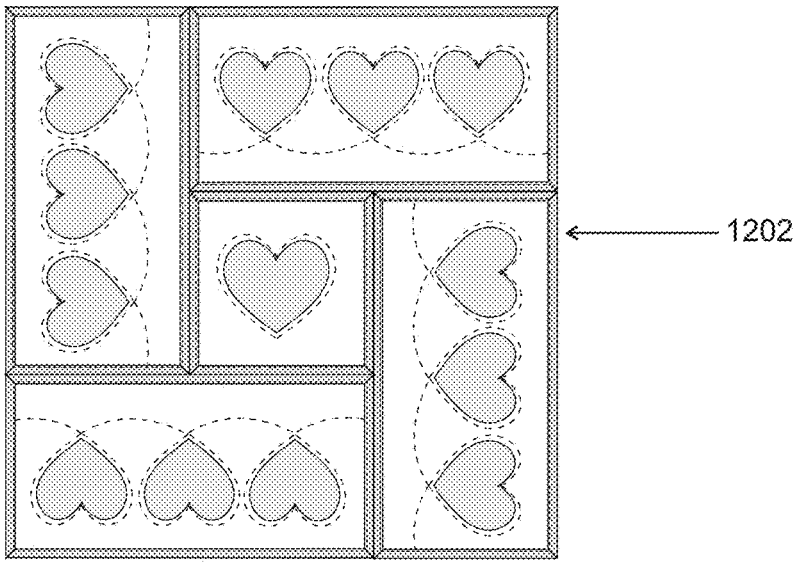
FIGS. 12A to 12B are drawings of quilts that follow the same joining method as the quilt blocks in FIGS. 11A to 11F with the quilt blocks varying in shape and sash width within the same quilt.
Figure 12B:
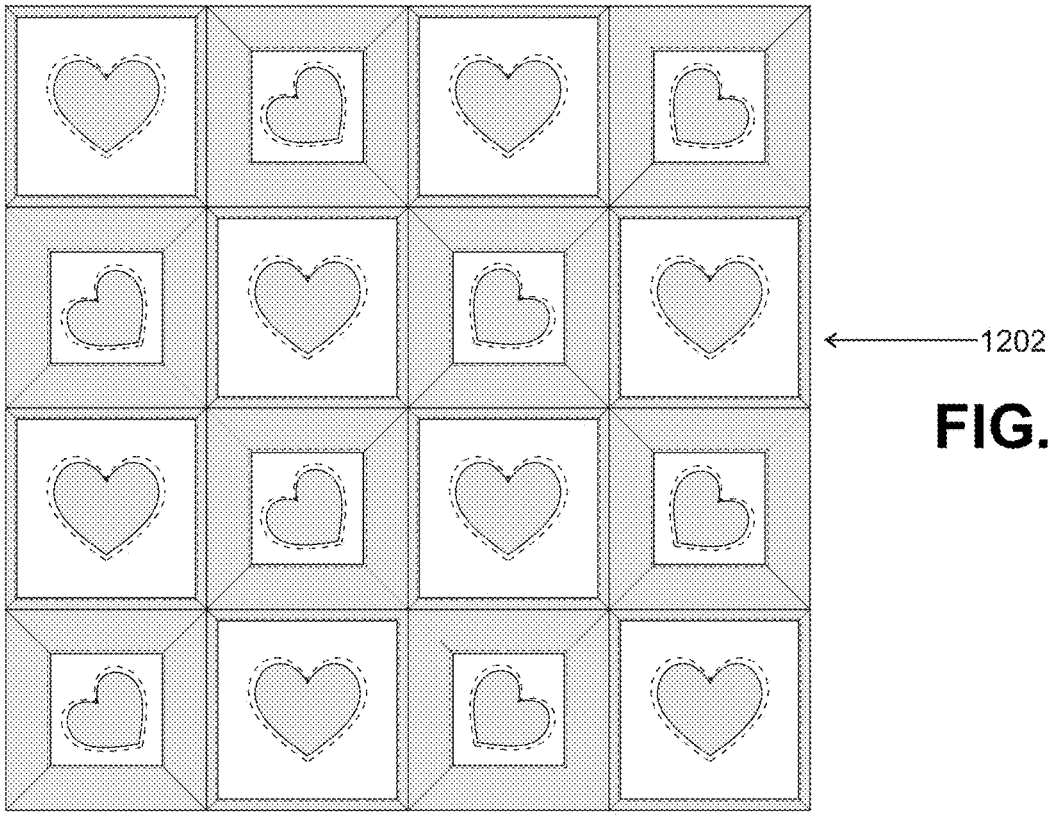

Using the same placement of the centering guide as previously described mark a convenient number of joining guides for a quilt where all sashes appear on the front of the quilt as in illustrations FIG. 11 and FIG. 12. Continue repositioning the centering guide and recording the top dot and, if needed the joining guides, until all the beveled edges of a quilt block have been marked FIG. 8, 814.

Figure 9:
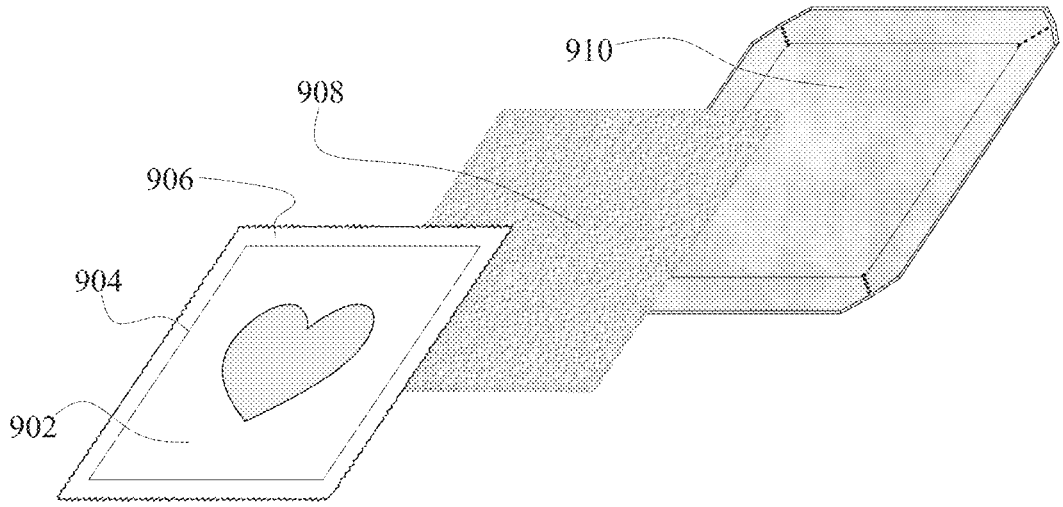
FIG. 9 is an illustration of the front view of the materials (feature fabric, batting and stabilized back/sash) ready to be stacked together to form a quilt block. It illustrates a quilt block with the long edges labeled to help identify their position while assembling a quilt.
Figure 10A:
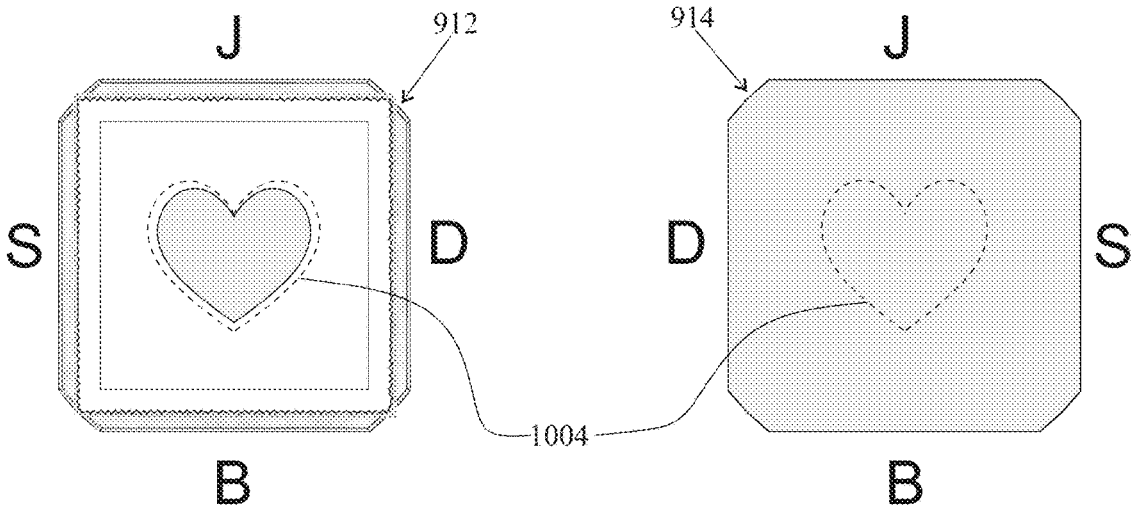
FIGS. 10A to 10G show one possible reversible quilt. The line drawings represent both the front and the back view because if one used the same featured fabric and back fabric to make the quilt the front and back would look the same. Also illustrated are the steps used to join quilt blocks to one another in one way that will produce this style of reversible quilt using the template and centering guide for an equiangular rectangle.
Figure 10B:
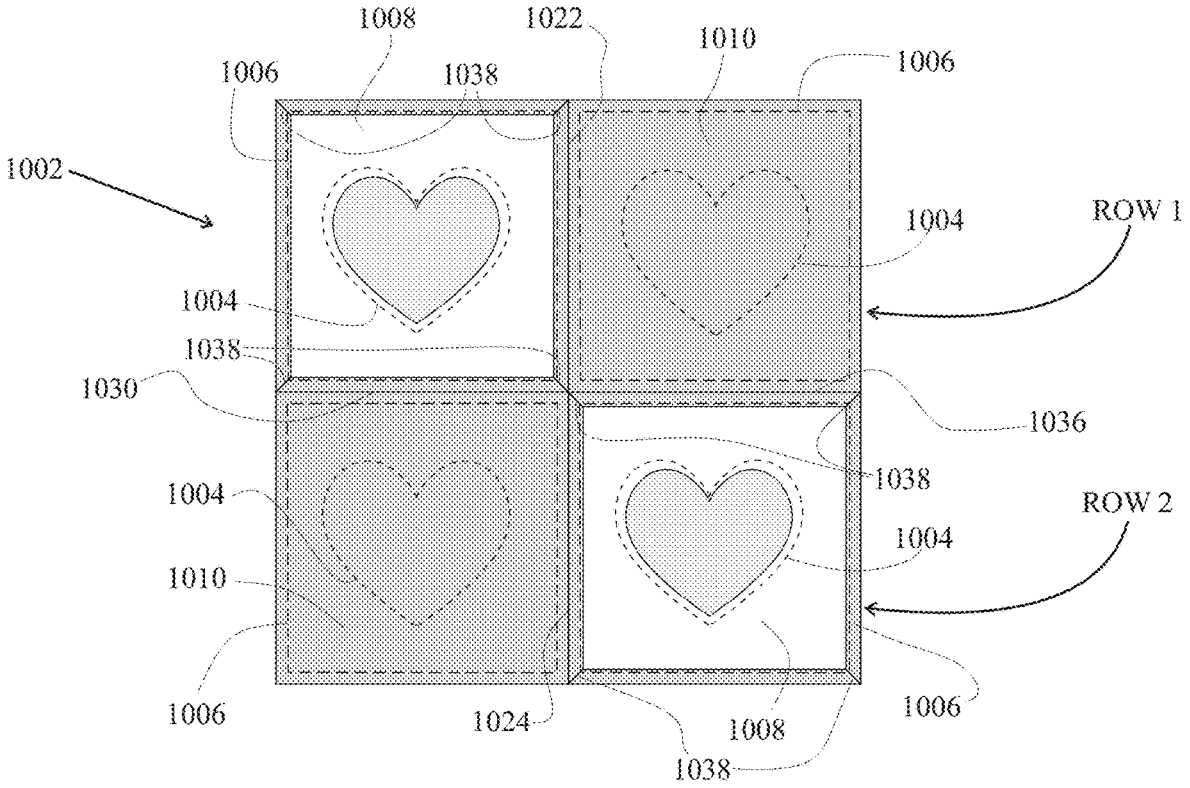
Figure 10C:
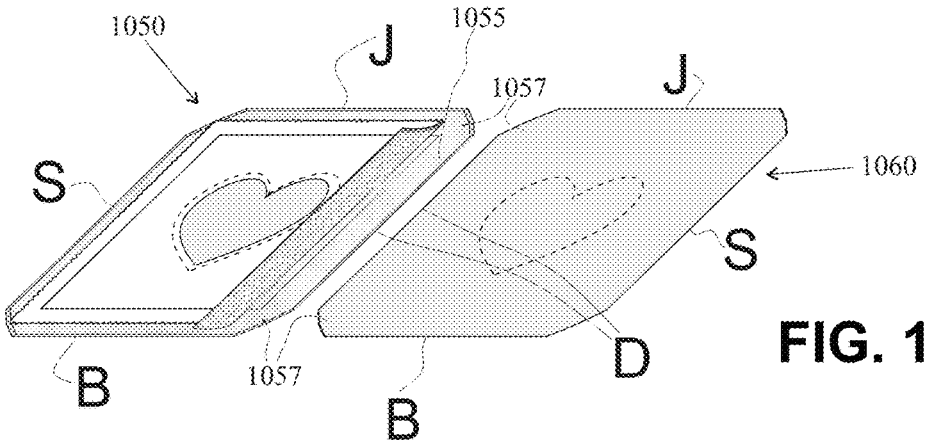
Figure 10D:
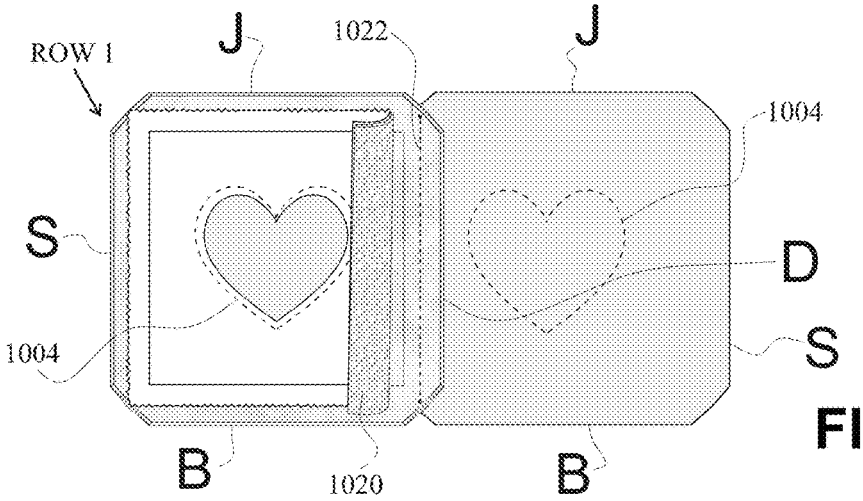
Figure 10E:
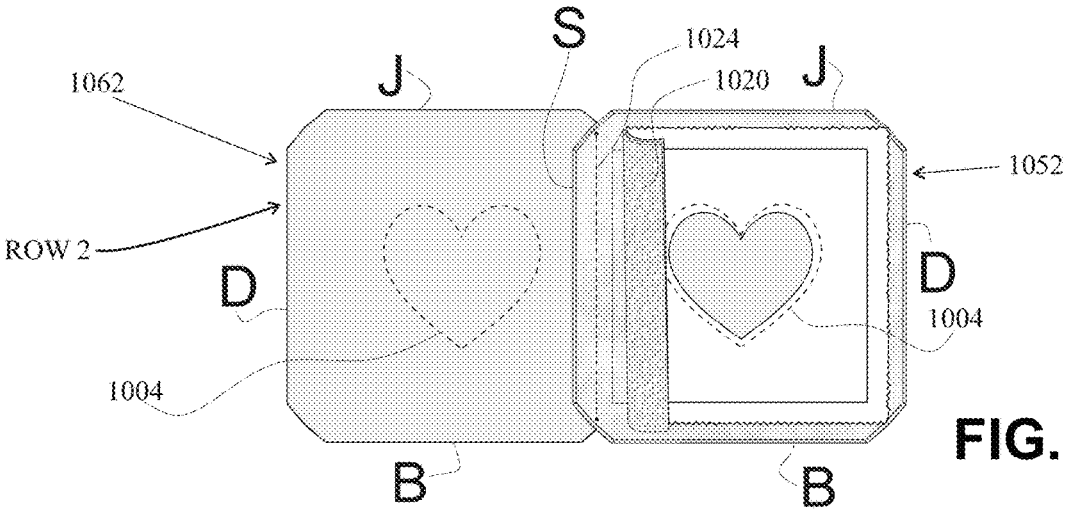
Figure 10F:
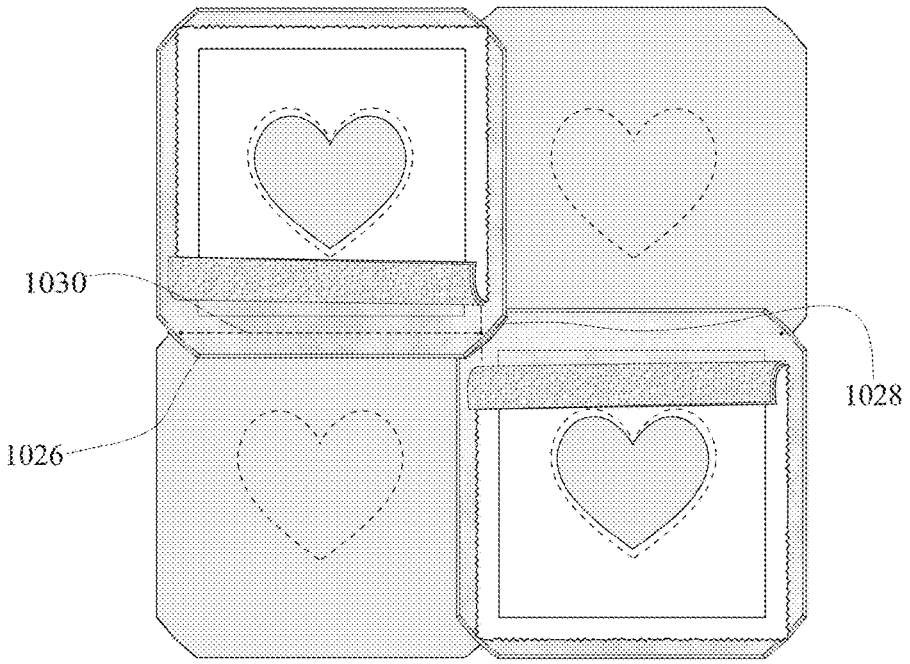
Figure 10G:
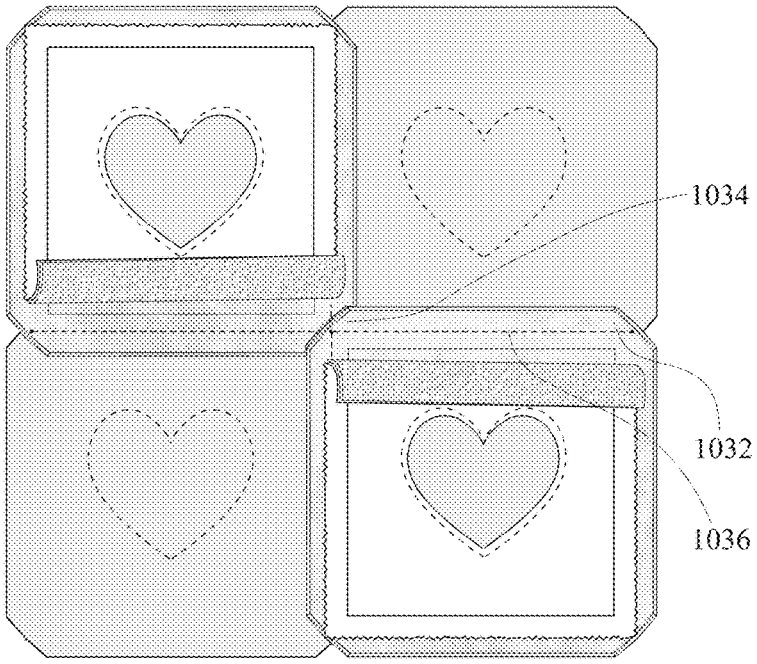
Figure 11A:
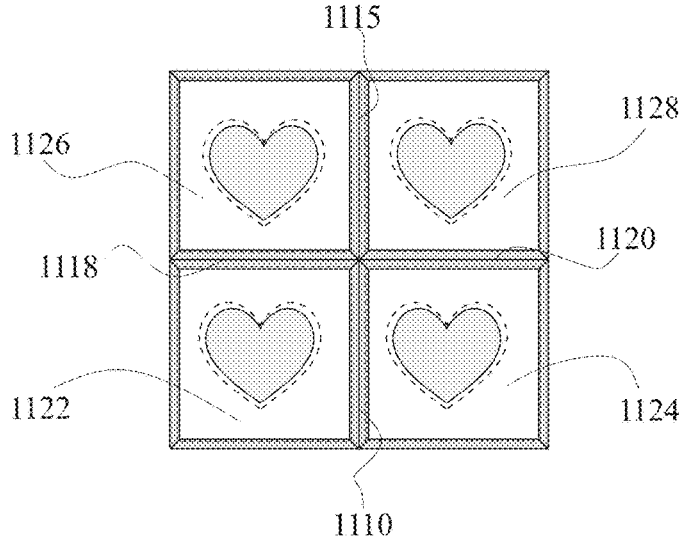
FIGS. 11A to 11F show the front view of a quilt and the method used to join quilt blocks to one another to make this quilt. Using this method produces a quilt with a distinct front and back using the template and centering guide for an equiangular rectangle.
Figure 11B:
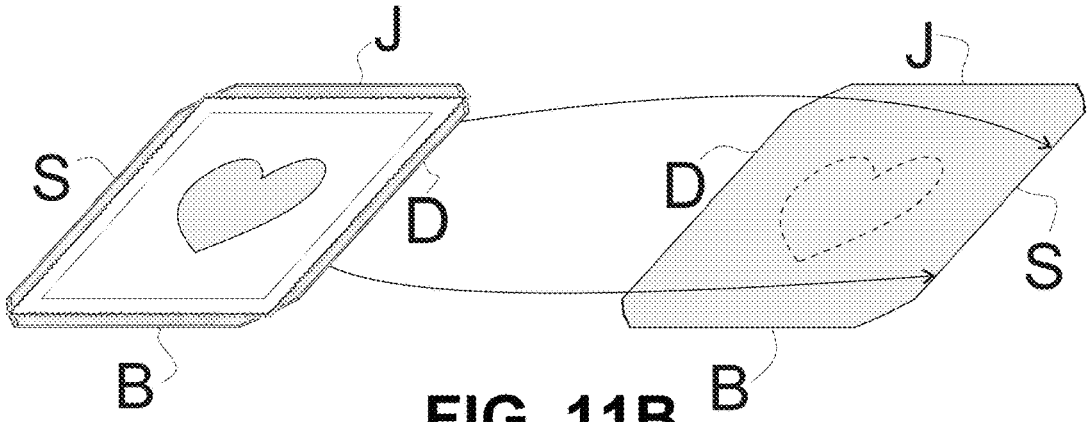
Figure 11C:
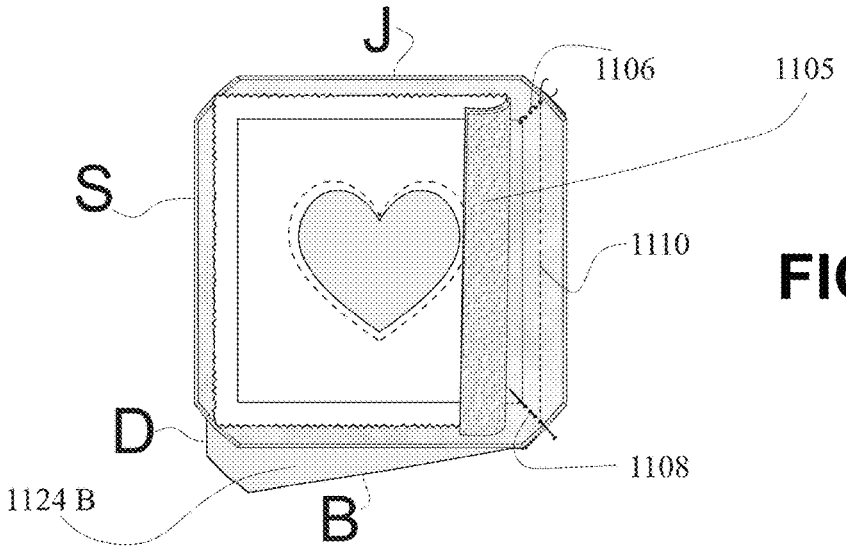
Figure 11D:
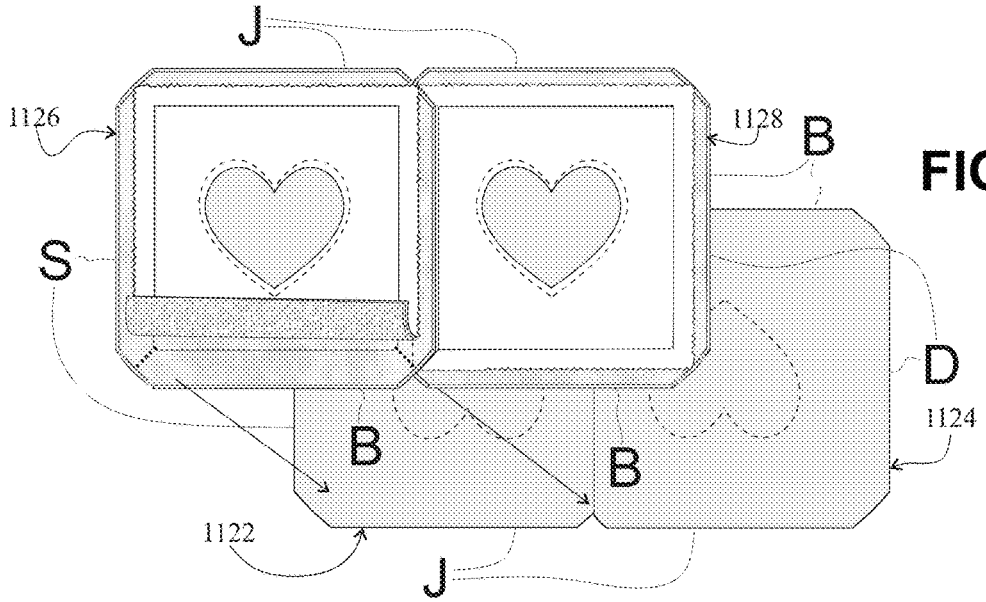
Figure 11E:
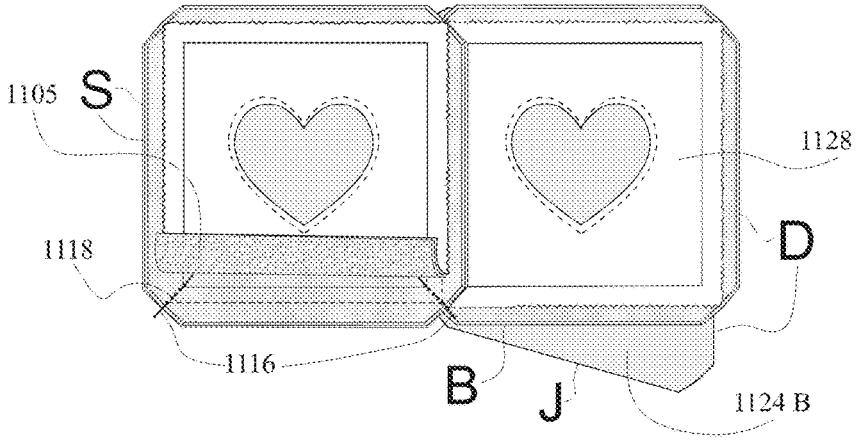
Figure 11F:
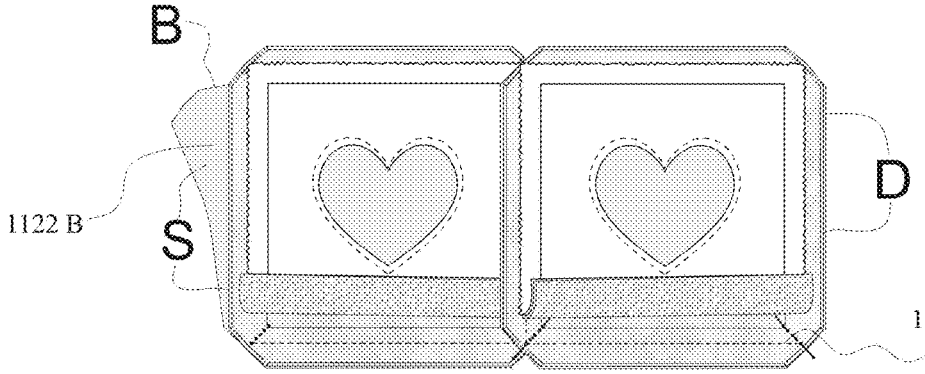

Add a border, at least 0.375" wide, in the outer geometry of the initial geometry drawn on the featured fabric. The choice of batting, amount of pad stitching, spacing of pad stitching, and fabric hand are some factors to consider when planning this border because thy all impact changes in the size of the featured fabric that are the result of pad stitching. Cut the featured fabric and any batting desired using this new border. Position any batting next to the right side of the stabilizer in the quilt back/sash and position the featured fabric on top of the batting. FIG. 9, 902 is the featured fabric. 904 is the equiangular shape outlining the featured area of the fabric, 906 is the border drawn outside the initial geometry of the featured fabric. 908 is a representation of batting. 910 is the stabilized quilt back/sash. Pad-stitch if required (pad stitching is determined by the size of the quilt block, the choice to install batting, the kind of batting used, and personal preference). 912 illustrates the front view of a stacked, pad-stitched quilt block with letters distinguishing each long edge of the block.

Letters (S, J, D, B) associated with a quilt block's long edges are related to the front of each block and when quilt blocks are flipped the lettering is flipped as well. 914 is an illustration of the back of a quilt block.

FIG. 10, 1002 shows a top view of a reversible quilt made by alternating a quilt block front up and quilt blocks front down as the quilt is assembled. 1004 is pad stitching. 1006 are the stitches that secure the sashes and they are placed parallel to the folds which form the sashes. 1008 represents fronts of quilt blocks. 1010 represents the backs of quilt blocks.

Move one quilt block with its front up 1050 so that the sash close to long edge D 1055 is positioned on top of a quilt block 1060 which is turned front down. The quilt blocks should be positioned backs together, so the top dots marked on the beveled edges located at both ends of long edge D 1057 align on both upper and lower quilt blocks. Pull any feature fabric and batting out of the area to be sewn 1020 and sew the quilt blocks to one another between the aligned top dots following a straight line 1022. Side D of the front down quilt block is hidden by the overlapping sash of the front facing quilt block. Continue joining alternating quilt blocks to one another in this fashion until a row is completed (determined by the quiltmaker). This is ROW 1 (In this example ROW 1 has two quilt blocks). The direction the first quilt block in ROW 2 faces is determined by the row above it. If the first quilt block in ROW 1 is front up the first quilt block in ROW 2 is front down. If the first quilt block in ROW 1 is front down the first quilt block in ROW 2 is front up. In this illustration, ROW 2 starts with a quilt block positioned with its front down. Move one quilt block with its front up 1052 so that the sash close to long edge S is positioned on top of a quilt block 1062 which is turned front down (Side S on the lower quilt block is hidden under the overlapping front facing quilt block). The quilt blocks should be positioned backs together, so the top dots marked on the beveled edges located at both ends of long edge S 1057 align on both upper and lower quilt blocks.

Pull any feature fabric and batting out of the area to be sewn 1020 and sew the quilt blocks to one another between the aligned top dots following a straight line 1024. Continue joining alternating quilt blocks to one another in this fashion until a row is completed (determined by the quilt maker). This is ROW 1 (In this example ROW 2 has two quilt blocks).

Side B of the upper row of quilt blocks (ROW 1) will be joined to side J of the lower row of quilt blocks (ROW 2). Position quilt blocks facing front up in ROW 1 so they overlap quilt blocks facing front down in ROW 2. The top dots that are positioned in the beveled edges on each side of long edge B in the upper row (ROW 1) must align with the top dots that are positioned in the beveled edges on each side of long edges J in the lower row (ROW 2). The seam allowances of the all the beveled edges in the intersection of the quilt blocks should be pushed out of the way of the intended stitching path 1028. Sew the quilt blocks positioned front up in ROW 1 to the quilt blocks positioned front down in ROW 2 following a straight line from top dot to top dot 1030.

Complete joining the rows to one another by positioning quilt blocks facing front up in ROW 2 so they overlap quilt blocks facing front down in ROW1. The top dots that are positioned in the beveled edges on each side of long edge J in the lower row (ROW 2) must align with the top dots that are positioned in the beveled edges on each side of long edges B in the upper row (ROW 1). The backs of the quilt blocks are together where they overlap one another. The seam allowances of the all the beveled edges in the intersection of the quilt blocks should be pushed out of the way of the intended stitching path 1028. Sew the quilt blocks positioned front up in ROW 2 to the quilt blocks positioned front down in ROW 1 following a straight line from top dot to top dot 1030. Trim any extra batting or feature fabric that may get in the way when the sash area of the back/sash gets folded to the front.

Sew each beveled edge closed 1038. Secure the sash to the feature fabric concealing any raw edges of the featured fabric. Here it is accomplished by topstitching through all layers of the quilt 1006, The quilt in FIG. 11 is made using the same template and centering guide as the one pictured in FIG. 10. The difference in appearance is due to the position of the quilt blocks as they are joined to each other. Rows of quilt blocks are joined to one another by placing quilt blocks back sides together, with long edge D of the front up quilt block positioned close to long edge S of the front down quilt block, Align the joining guides in the beveled edges at both ends of long edge D of the front up quilt block to the joining guides at both ends of long edge S in the front down quilt block. Hold the quilt blocks together along the aligned joining guides using a temporary technique such as basting the quilt blocks to one another through the joining guides 1106 or pinning through the joining guides 1108. In this instance, using multiple joining guides prevents accidentally distorting the remaining sashes because the center of the quilt block is not pulled out of alignment to have the long edges meet. Fold any batting or featured fabric away from the intended stitching lines 1105 and sew the quilt blocks to each other from top dot to top dot in a straight line near the long edges which were temporarily held together at their joining guides 1110. Use the same method to add more quilt blocks to the same row and to form as many rows as needed (the illustration has only 2 blocks in the row). Remove any temporary stays along the joining guides.

Join the rows of quilt blocks to one another by aligning the joining guides positioned in the beveled edges on either sides of the long edges B of one row of quilt blocks to the joining guides positioned in the beveled edges on either side of the long edges J on the remaining row of quilt blocks, Use a temporary method to hold the quilt blocks aligned as described 1116. Fold any feature fabric and batting out of the stitching line 1105. Push any seam allowances of the beveled edges out of the way of the intended stitching line and sew quilt blocks to each other from top dot to top dot along a straight line at the long edges which are temporarily held in place 1118. Join the remaining rows of quilt blocks to one another following the same procedure 1120.

After the rows are joined to each other remove all the methods of aligning the joining guides. Trim any featured fabric or batting that may interfere with the sashes folding into position.

Close all the beveled edges.

Sew sashes in place covering the batting and the raw edges of the featured fabric in this example. This is accomplished by top-stitching through all layers.

When a quiltmaker wishes to install a row of new quilt blocks, they can remove the stitching holding a row of exterior sashes in place as well as the beveled edges of said sashes. After the stitches are removed the quilt maker can sew more quilt blocks to the sashes, which are no longer held in place with stitches, following the method used to construct the quilt. Adding more quilt blocks to a finished quilt applies to all quilt styles made using this method.

FIG. 12 shows two additional quilt possibilities using the ninety-degree combination template and centering guide. 1202 Is the front view of a quilt style made by using quilt blocks of rectangles combined with a square. The other example 1204 is a front view of a quilt made by combining quilt blocks with significantly different sash widths in the same quilt.

Figure 13A:
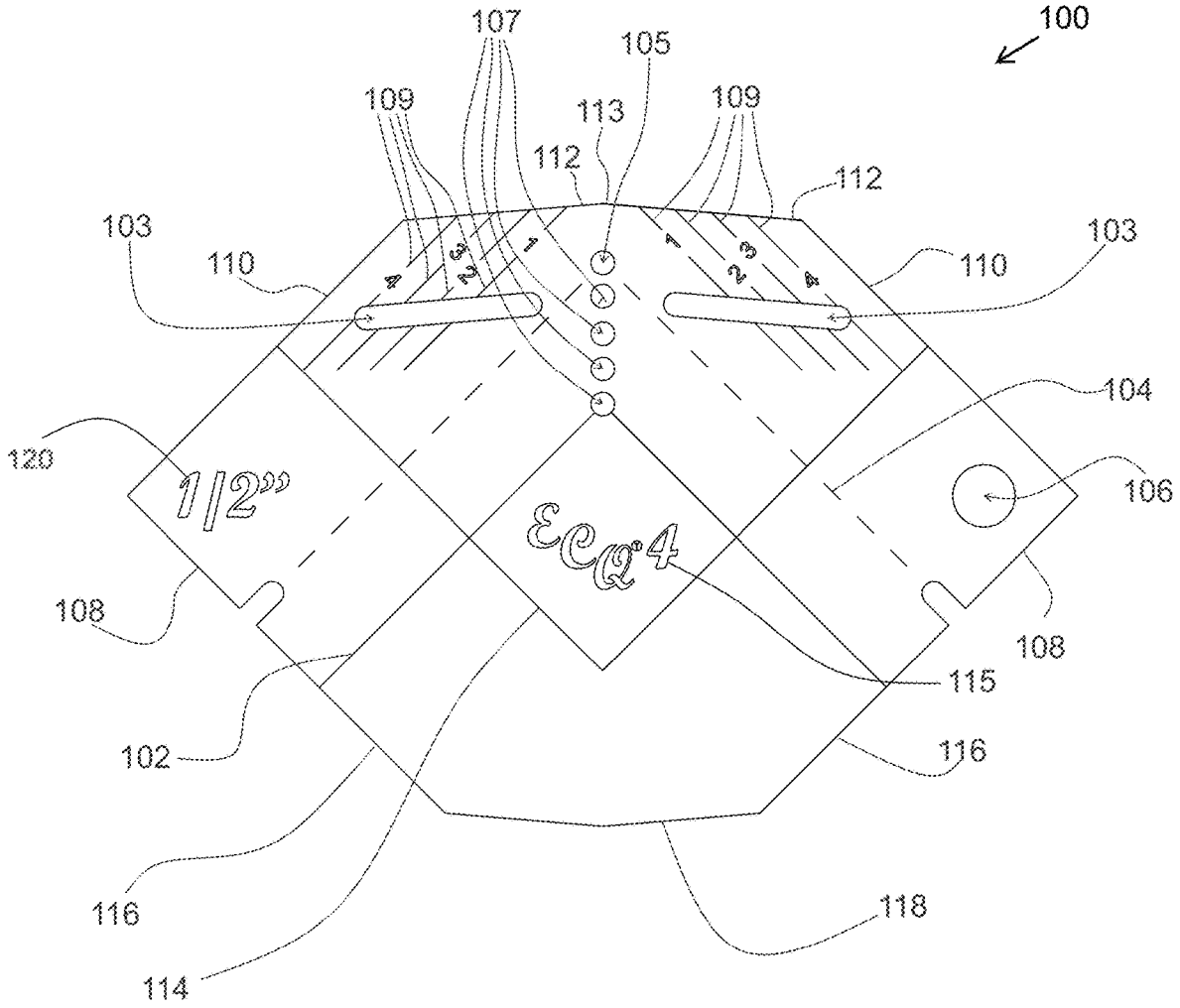
FIG. 13A shows a top view of a template for constructing a quilt with ¼" sashes when the equiangular shape has four sides, according to one embodiment.

Turning to FIGS. 13 to 34, one embodiment of a template 1300 for producing a quilt block with ½" sash widths is shown in FIG. 13A. It should be noted that although the template shown in FIG. 13 is intended to produce a quilt block with ½" sash width, templates with other sash widths are possible according to the devices and methods described herein. The templates described herein to make quilt blocks for various equiangular shapes can all be made using the same formula (algorithm), as described below. It should also be noted that the appearance and function of each template is dependent on an initial angle 102 of the template.

Figure 13B:
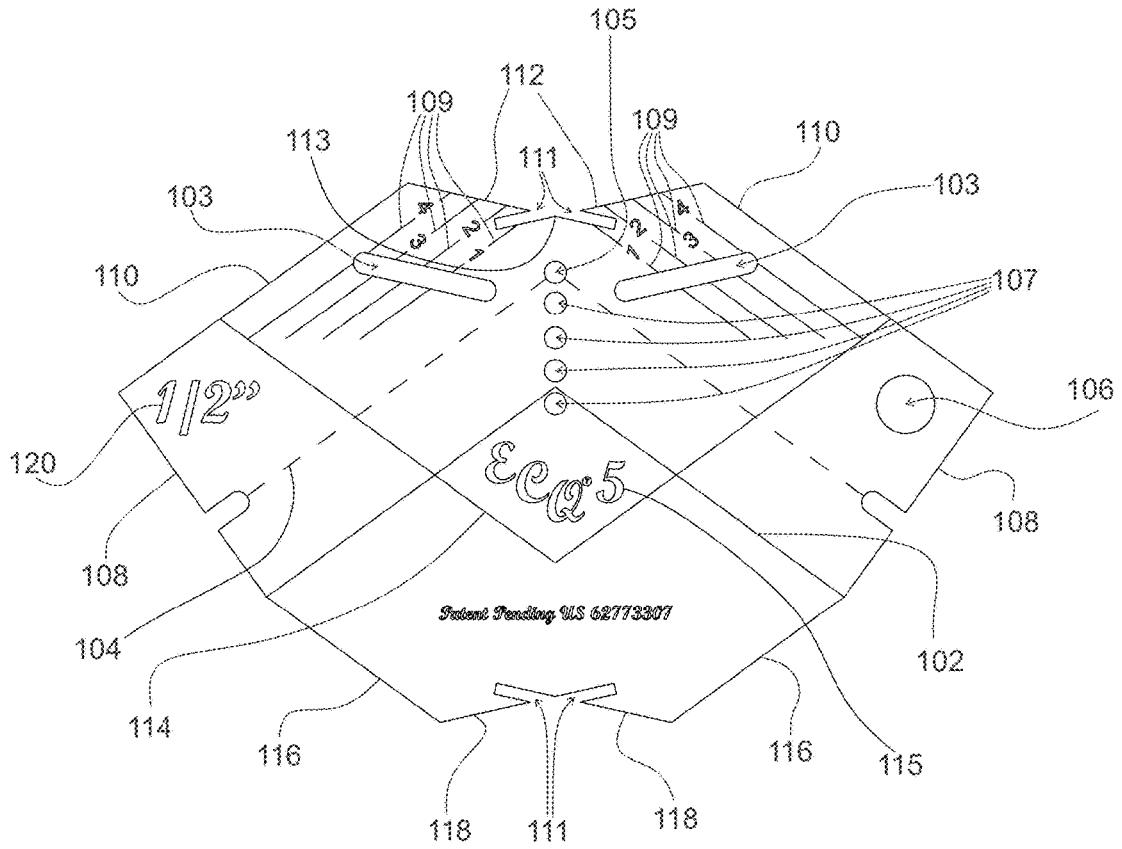
FIG. 13B shows a template for constructing a quilt with ½" sashes when the equiangular shape has five sides, according to one embodiment.

FIG. 13B shows a template for constructing a quilt with ¼" sashes when the equiangular shape has five sides, according to an embodiment.

Figure 13C:
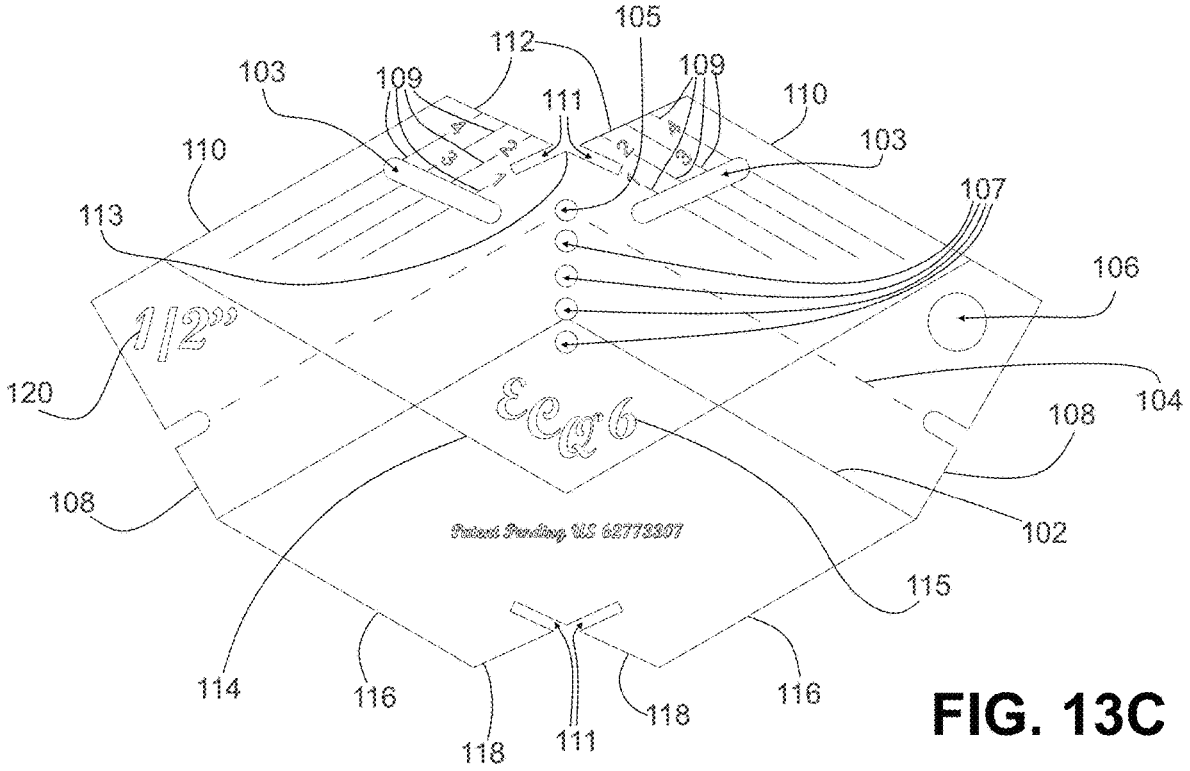
FIG. 13C shows a template for constructing a quilt with ½ " sashes when the equiangular shape has six sides, according to one embodiment.

FIG. 13C shows a template for constructing a quilt with ½" sashes when the equiangular shape has six sides, according to an embodiment.

Figure 13D:
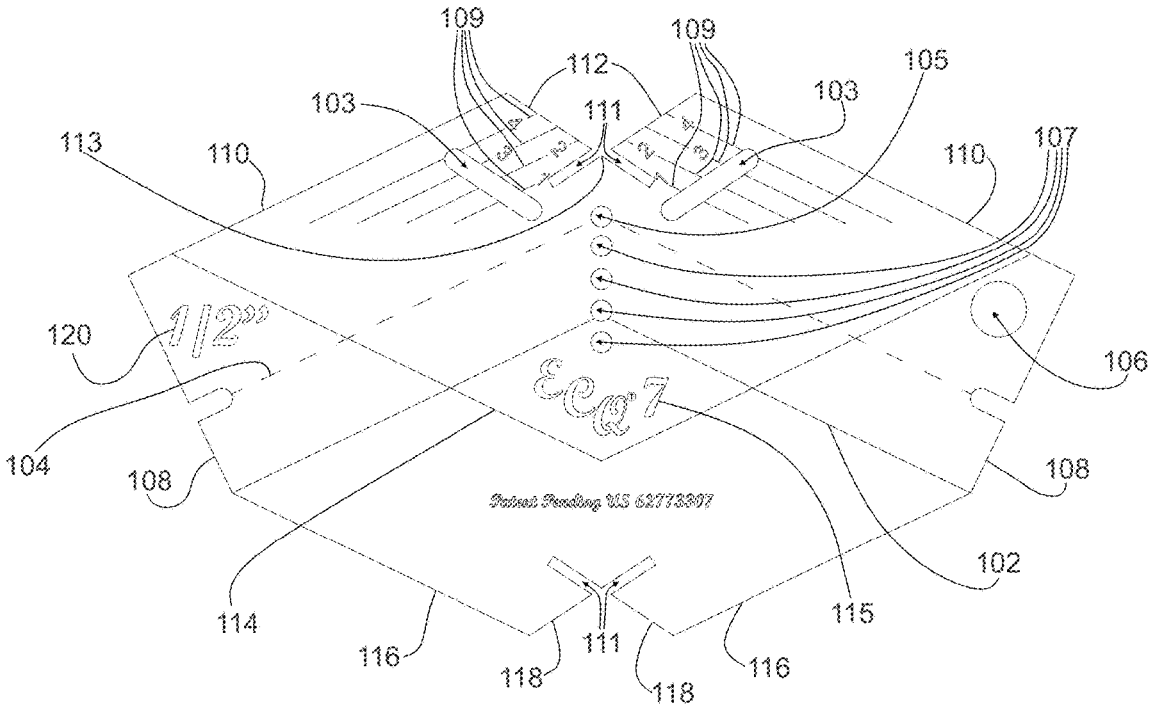
FIG. 13D shows a template for constructing a quilt with ½" sashes when the equiangular shape has seven sides, according to one embodiment.

FIG. 13D shows a template for constructing a quilt with ½" sashes when the equiangular shape has seven sides, according to an embodiment.

Figure 13E:
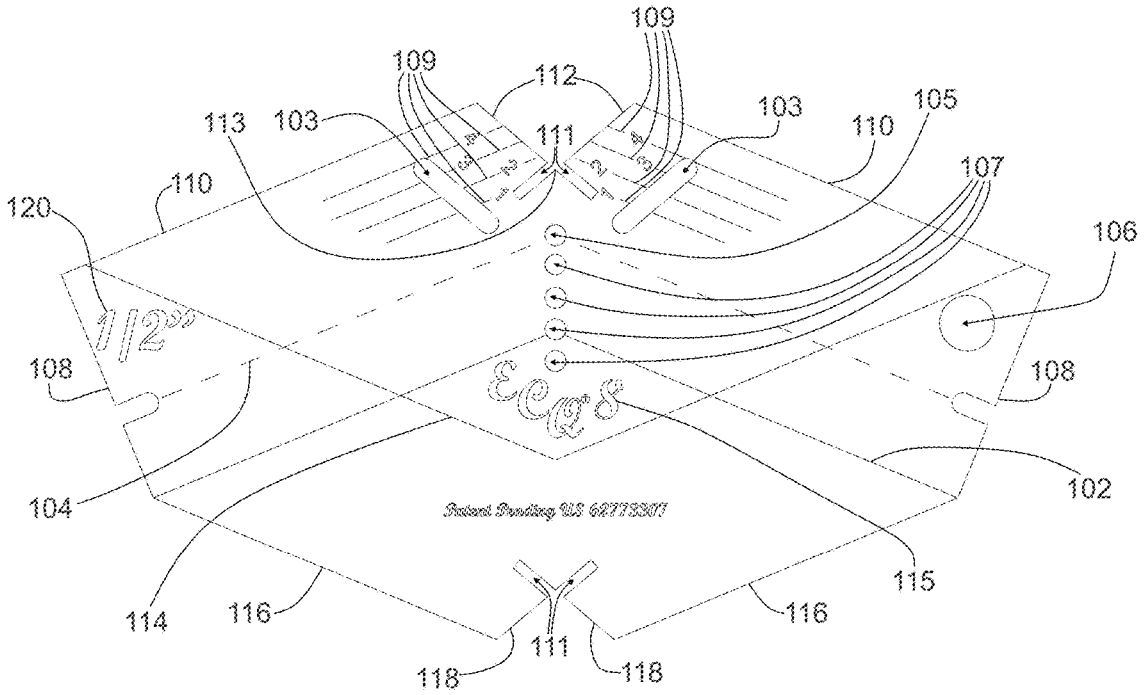
FIG. 13E shows a template for constructing a quilt with ½ " sashes when the equiangular shape has five sides, according to one embodiment.

FIG. 13E shows a template for constructing a quilt with ¼" sashes when the equiangular shape has five sides, according to an embodiment.

The template 100 shown in FIG. 13A is combination template that includes a centering guide (that includes, for example, a top dot 105, holes 107 and markings (e.g. centering placement guides or placement guides) 109), a back/sash template and a coordinating stabilizer template in one unit.

Dashed lines 104 are stitch placement guides and indicate where stitches will be placed to join quilt blocks to one another when forming a quilt. The dashed lines 104 also indicate a point of transition from the quilt block back to the quilt block sash.

The template can be formed using transparent or translucent plastic such as but not limited to an acrylic-based plastic. A template can be anywhere from 0.004" to 0.5" thick and is generally rigid.

Angle 102 (FIG. 13A) is a duplicate of (i.e. equal to) the initial angle. For example, if the initial geometry is a square, angle 102 is a 90-degree angle, if the initial geometry is a pentagon, angle 102 is a 72 degree angle, and so on. Angle 102 of template 1300 is positioned at the angled edges of the initial geometry to determine the shape of the backlsash (see for example shape 504 in FIG. 5), Numeral 115 indicates the number of sides in the initial geometry.

Label 120 indicates a width of the sash produced using the template. Elongated openings 103 are installed in the template to position marks for use when folding material to form a beveled edge. Elongated openings 103 also help install a mark two times the distance of the seam allowances' depth from the cut edge.

Dot (e.g. hole or aperture) 105 is also referred to herein as a "top dot." Top dot 105 provides for the installation of marks indicating the beginning and end of stitch lines when joining quilt blocks to one another. Top dot 105 helps to align quilt blocks to one another and are part of the centering guide. Top dot 105 is installed at the intersection of line segments 104.

Holes 107 are holes considered joining guides. Joining guides 107 always include the top dot 105. Joining guides 107 are positioned along a center axis of the template 1300 and are positioned about 0.02" to about 0.5" from the top dot and from each other. It is important to copy the centering guides and position them the same way on all quilt templates when combining quilt blocks of different sash widths.

Aperture 106 is a hole drilled in the template 1300 for hanging the template 1300, for example on a hook.

Line segments 109 positioned on both sides of the joining guides 107 are line segments extending along a top surface of the template 1300. Line segments 109 are also referred to herein as centering placement guides 109. The centering placement guides 109 are line segments that, if they were continued to intersect one another, the angle formed at the intersection of the centering placement guides 109 would be the same angle as the initial angle 102. Each centering placement guide 109 is related to its mirror image on the other side of the joining guides 107 and this relationship must be apparent. In other words, the centering placement guide 109 closest to side 110 on the left of the template 100 is related to (e.g. corresponds to) centering placement guide 109 closest to side 110 on the right side of the template. To indicate this relationship, each centering placement guide 109 should be labelled to correspond with its corresponding centering placement guide 109 on the other side of the template 100, for instance by having a same color, a same number (as shown in FIG. 13A), or any other way of visually announcing their relationship.

Individual centering placement guides 109 on a same side of the center axis of the template 1300 are parallel to each other, as shown in FIG. 13A. The number of centering placement guides 109 can vary based on the amount of space in a quilt template (e.g. from about 0.5" to about 9") and their distance from one another (e.g. about 0.02" to about 0.75"). Line segments 108 bridge the line outer points of initial angle 102 and the line outer points of line segments 110. Line segments 108 have channels to allow for the marking of stitching lines. Lines 110 are copies of the line segments which intersect to form angle 102.

The copied line segments are offset in the outer geometry of angle 102 a distance equaling the depth of back/sash, Lines 110 will determine the position of the long edges of the quilt block. For further clarity, line segments 102 are copied and the copies are positioned in the outer geometry of angle 102. The distance the line segments are positioned from line 102 is equal to 2 times the sash depth+favoring+fold absorption+seam allowance (i.e. the depth of back/sash). The yare labelled lines 110.

Line segments 110 are reduced in length starting at their LAPs by an amount between about 0.02" and 0.375 with the amount of the reduction being determined by the favoring allowance. Altered LAPs of line segments 110 are still considered LAPs.

Angle 112 is a beveled edge derived from the initial angles used to establish angle 102. Position 113 indicates the position of point "P" on the beveled angle.

Lines 110 combined with angle 112 form the cutting edge of the back/sash template and are guides for tracing or rotary cutting, Angle 114 equates to the initial angle 102 and the guide used to position a template at the edges of the initial geometry when establishing the shape of a quilt block's stabilizer (see FIG. 4, 405).

Referring now to FIG. 13B, illustrated therein is another embodiment of a template 1302. In this embodiment, channels 111 are for use with a rotary cutter. Channels 111 are not required in templates for use with rectangle and triangle initial geometry. Lines 116 spaced apart from and parallel to the line segments that intersect to form angle 114. Lines 116 are offset in the outer geometry of angle 114 a distance equaling the depth of back/sash, Lines 116 are shortened at their LAPs an amount equal to that taken away from line 110 at its LAP. Altered ends of line segments 102 and lines 116 are still considered LAPs. Lines 116 are shortened to intersect angle at the end points not considered LAPs. Lines 116 will determine the position of the long edges of the stabilizer. Angle 118 bridges the shortened LAP points of lines 116. The angle of the line segments forming angle 118 mimic and mirror the angle made by the intersection of line 110 to angle 112. Line segments 116 plus angle 118 form the cutting edge of the quilt stabilizer part of the template.

Figure 14A:
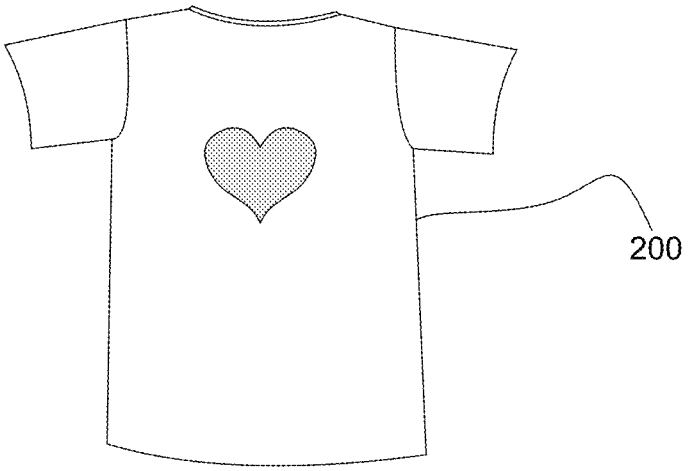
FIGS. 14A-14C show a textile product that contains a decoration intended for the featured fabric having an initial geometry.
Figure 14B:
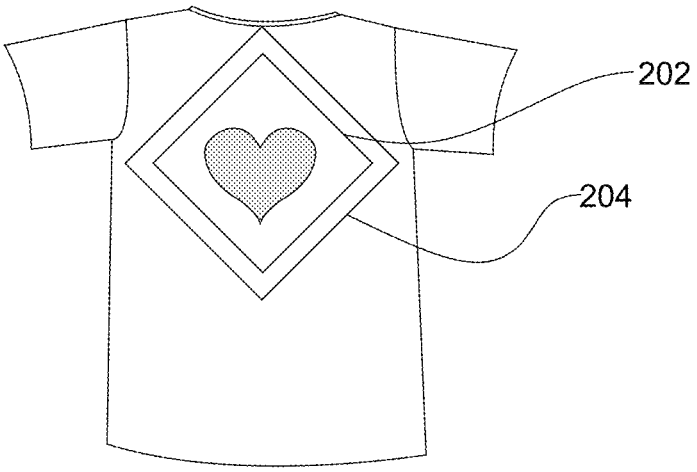
Figure 14C:
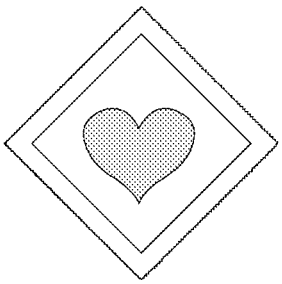
Figure 15:
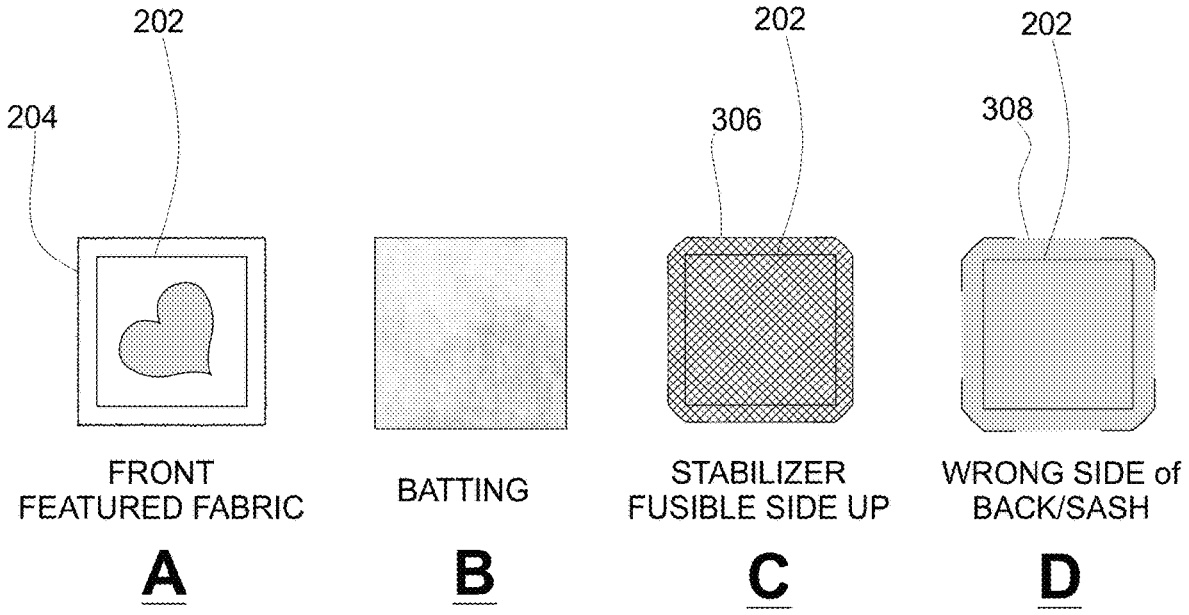
FIGS. 15A-D show all of the pieces of a quilt block, according to one embodiment.

Turning to FIGS. 14A-14C, illustrated therein is a textile product 200 that contains a decoration intended for the featured fabric having an initial geometry 202. Border 204 is drawn surrounding the initial geometry 202 at least 0.25" to 3" larger than the initial geometry 202.

FIGS. 15A-D show all of the pieces of a quilt block. For example, batting is cut approximately the size of the featured fabric. The stabilizer is cut using the stabilizer pattern shown in FIGS. 16A-C. The back is cut using the back pattern shown in FIG. 17. If the initial geometry 202 is copied onto the fabric and the stabilizer, the quilt block's back and stabilizer may be traced and/or cut without the use of a paper pattern. This practice may be suitable for making t-shirt quilts, for example, with a variety of featured fabric sizes. For instance, some t-shirts feature graphics on pockets and sleeves which present unusually long or small graphic sections.

Figure 16A:
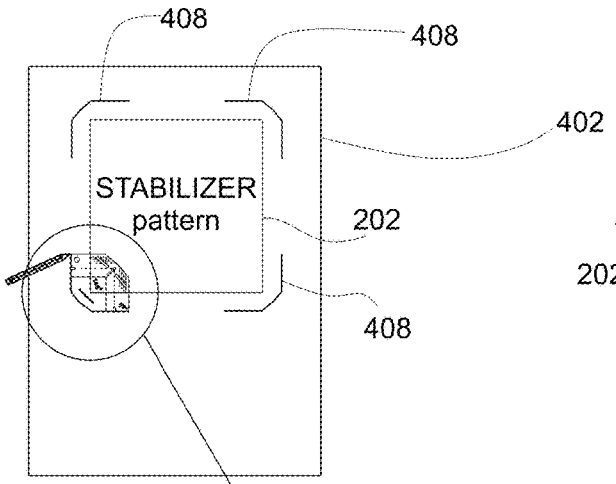
FIGS. 16A-C show the steps used in making a pattern for cutting the stabilizing layer of a quilt block when all the quilt blocks are going to be the same size and have the same sash depth, according to one embodiment.
Figure 16B:
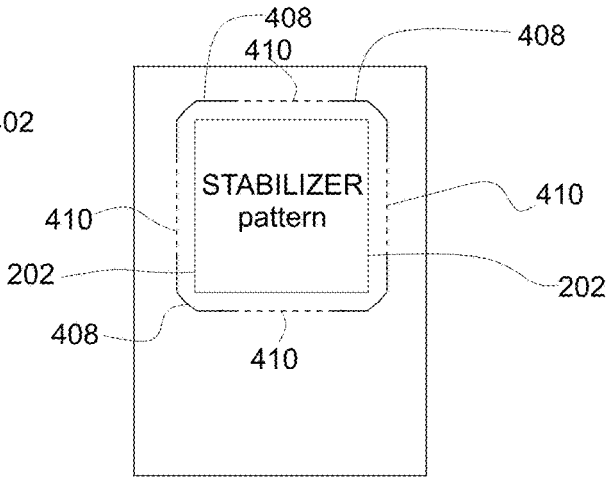
Figure 16C:
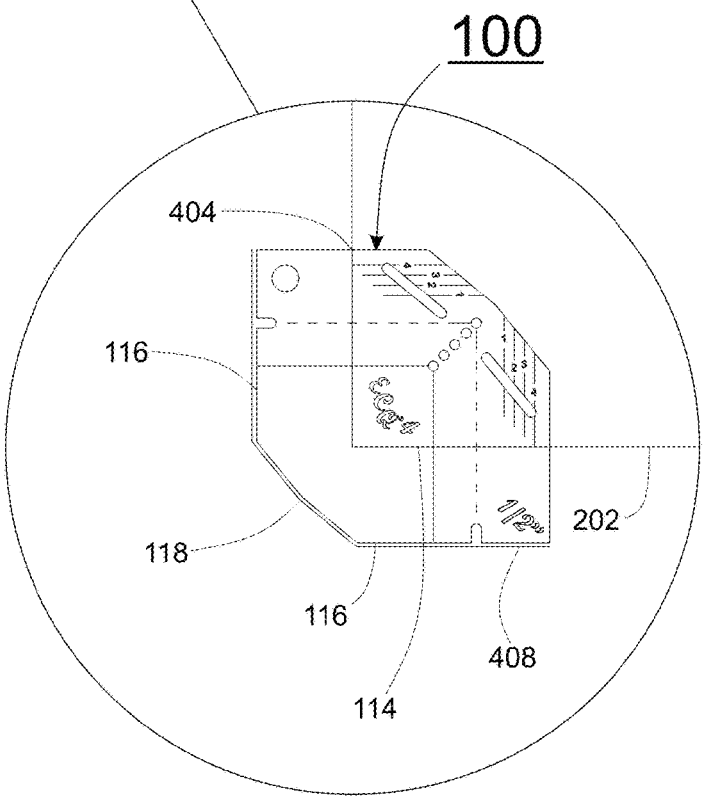

FIGS. 16A-C show the steps used in making a pattern for cutting the stabilizing layer of a quilt block when all the quilt blocks are going to be the same size and have the same sash depth.

At a first step shown in FIGS. 16A and 16C, the template 1300 is positioned such that line 114 of the template 1300 sits on (e.g. is aligned with) one of the angles (e.g. a corner)

of the initial geometry 202 drawn on the paper 402. Edge 404 of the initial geometry 202 is aligned with the line 114. Tracings (e.g. corners) 408 are added to the paper 402 along the edges 116 of the template 1300 and along angle 118 of the template 1300. After tracings 408 are added at each corner of the initial geometry 202, lines 410, shown in FIG. 16B, are added to the paper 402 to join tracings 408. Lines 410 and corners 408 are then joined to form an outside border of the stabilizer's pattern. The stabilizer pattern can be used to cut stabilizer pieces for each quilt block.

Figure 17A:
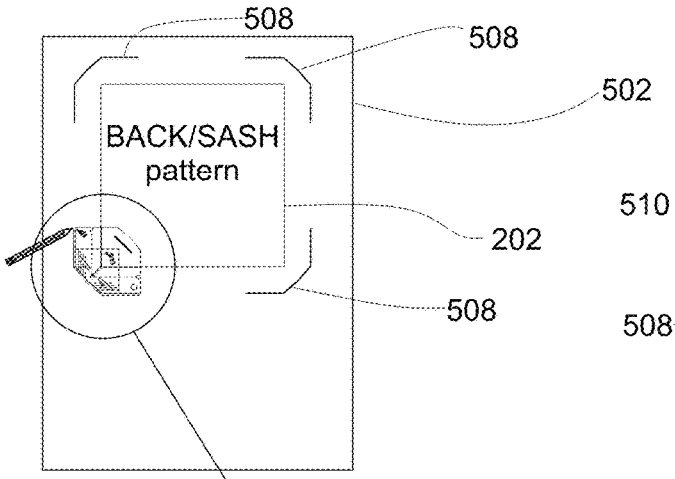
FIGS. 17A-17C show the steps used in making a pattern for cutting the back/sash layer of a quilt block when all of the quilt blocks are going to be the same size and have the same sash depth, according to one embodiment.
Figure 17B:
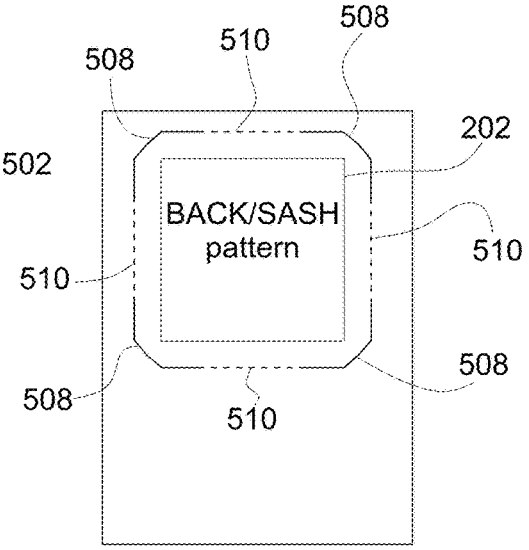
Figure 17C:
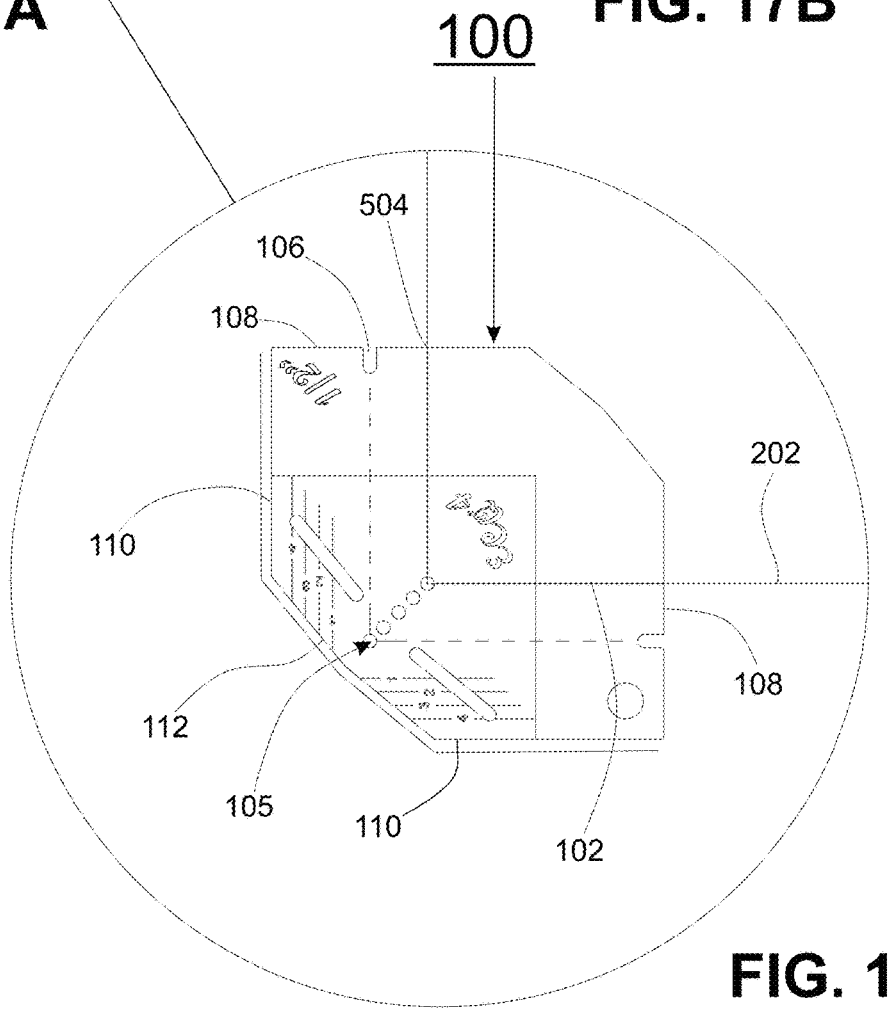

FIGS. 17A-17C show the steps used in making a pattern for cutting the back/sash layer of a quilt block when all of the quilt blocks are going to be the same size and have the same sash depth.

At a first step, as shown in FIGS. 17A and 17C, the template 1300 is positioned on a piece of paper 502 such that line 102 of the template 1300 sits on (e.g. is aligned with) one of the angles of the initial geometry 202 drawn on the piece of paper 502. Edge 504 of the initial geometry 202 is aligned with the lines 102 of template 1300. Tracings (e.g. corners) 508 are added to the paper 502 along the edges 110 of the template 1300 and along angle 112 of template 1300. After tracings 508 are drawn at each corner of the initial geometry 202, lines 510, shown in FIG. 17B, are drawn joining tracings 508. Lines 510 and corners 508 are joined to form an outside border of the back/sash pattern. The back/sash pattern can be used to cut back/sash pieces for each quilt block.

Figure 19A:
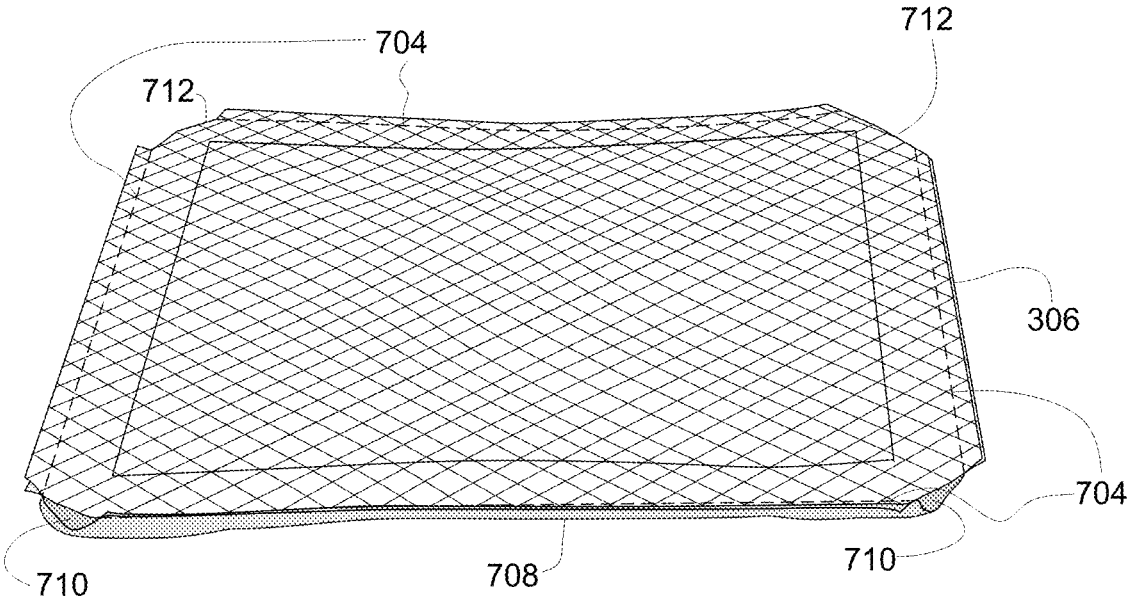
FIG. 19A shows a stabilizer on top of and being sewn to a back/sash piece, according to one embodiment.
Figure 19B:
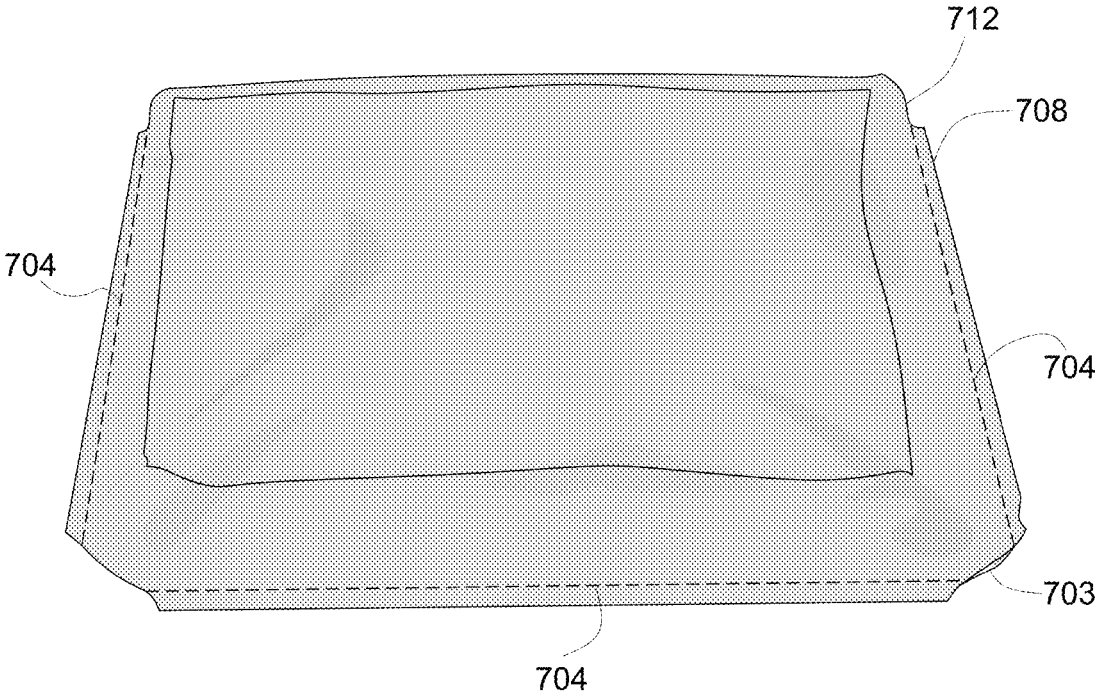
FIG. 19B shows the back/sash piece of FIG. 19A.

It should be noted that in this disclosure, the stabilizer 306 and the back/sash piece 708 are sewn to one another after matching their long edges (e.g. right sides) 704, as shown in FIGS. 19A and 19B. When a piece of stabilizer is fused to an unstable piece of fabric, the fabric can often become stretched and skewed. Any distortion of the unstable piece of fabric is difficult to correct because the back piece of the quilt block is fused to the stabilizer. If the back/sash fabric is stitched to the stabilizer before fusing, the back/sash fabric is less likely to be distorted and can even be "compressed" into shape before fusing.

Figure 18A:
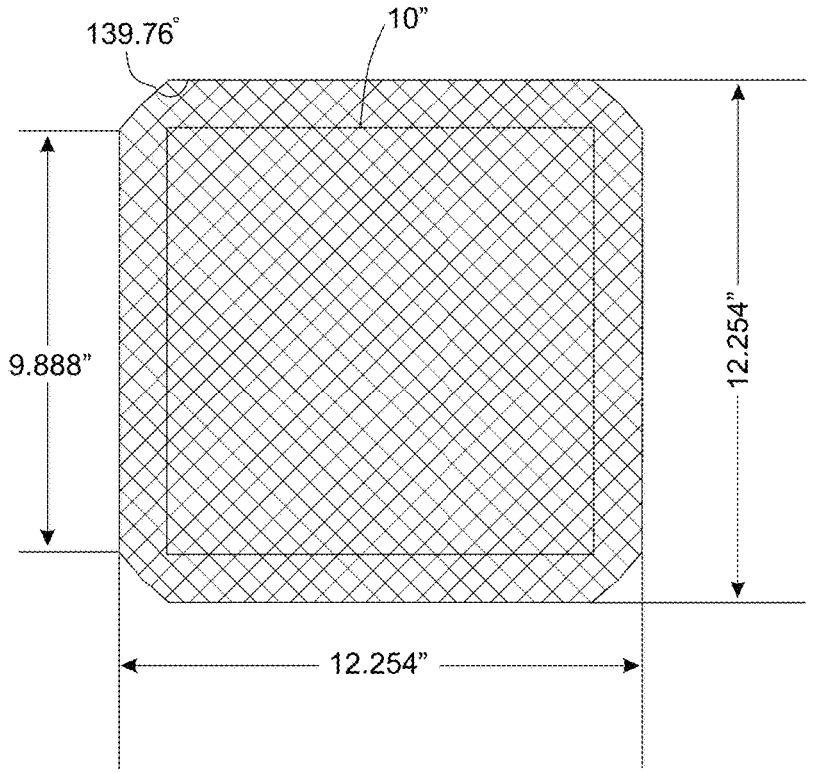
FIGS. 18A and 18B shows example drawings of computer-generated patterns made using the template of FIG. 13A.
Figure 18B:
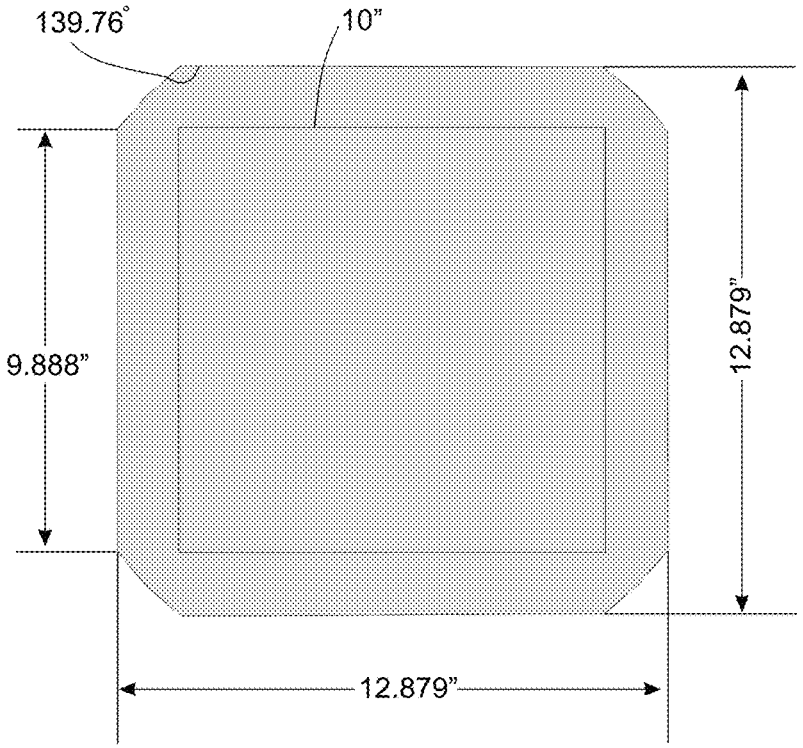

FIGS. 18A and 18B shows example drawings of computer-generated patterns made using the template 1300. Actual quilt blocks made using the devices may vary slightly due to tracing or cutting. Cutting stabilizer and quilt back/sash material using the template or patterns derived from it generally produces two different sized pieces. For instance, the back/sash piece is typically larger than the stabilizer piece. The long sides of both stabilizer and back/sash pieces are typically the same length. Having the same shaped angle on both the stabilizer and the back/sash fabric simplifies matching the pieces when sewing the stabilizer to the back/sash along their long edges.

In the devices and methods described herein, the stabilizer and the back/sash piece are joined to one another along their long edges, right sides (e.g. outsides) together, and then flipped right sides out, positioning the fusing agent next to the wrong side (e.g. inner side) of the sash/back. After flipping the fabric as previously described, the two pieces are fused together.

FIG. 19A shows the stabilizer 306 on top of and being sewn to the back/sash piece 708. The back/sash piece 708 is typically larger than the stabilizer piece 306 so when the long edges of both pieces are matched and sewn to each other, the extra fabric of the sash/back piece 708 pools in the center. In FIG. 19B, the surface of the sash/back piece 708 that is shown is the wrong side (e.g. inner side) of the back/sash piece. Portions 710 of the back/sash 708 and stabilizer 306 are left open at this stage. The quilt back/sash piece 708 and the stabilizer 306 are pulled to the right side through one of these openings (e.g. open portions). Portions 710 are folded and sewn to make the beveled edges of each quilt block. In FIG. 19A the fusible side of the stabilizer 306 is shown pointing upwardly. Stitching lines 704 show stiches joining the sash/back 708 to the stabilizer 306. FIG. 19B specifically shows the back/sash piece 708 being sewn to the stabilizer 306. Side 703 shows the right (e.g. outer) side of the stabilizer 306.

Figure 20:
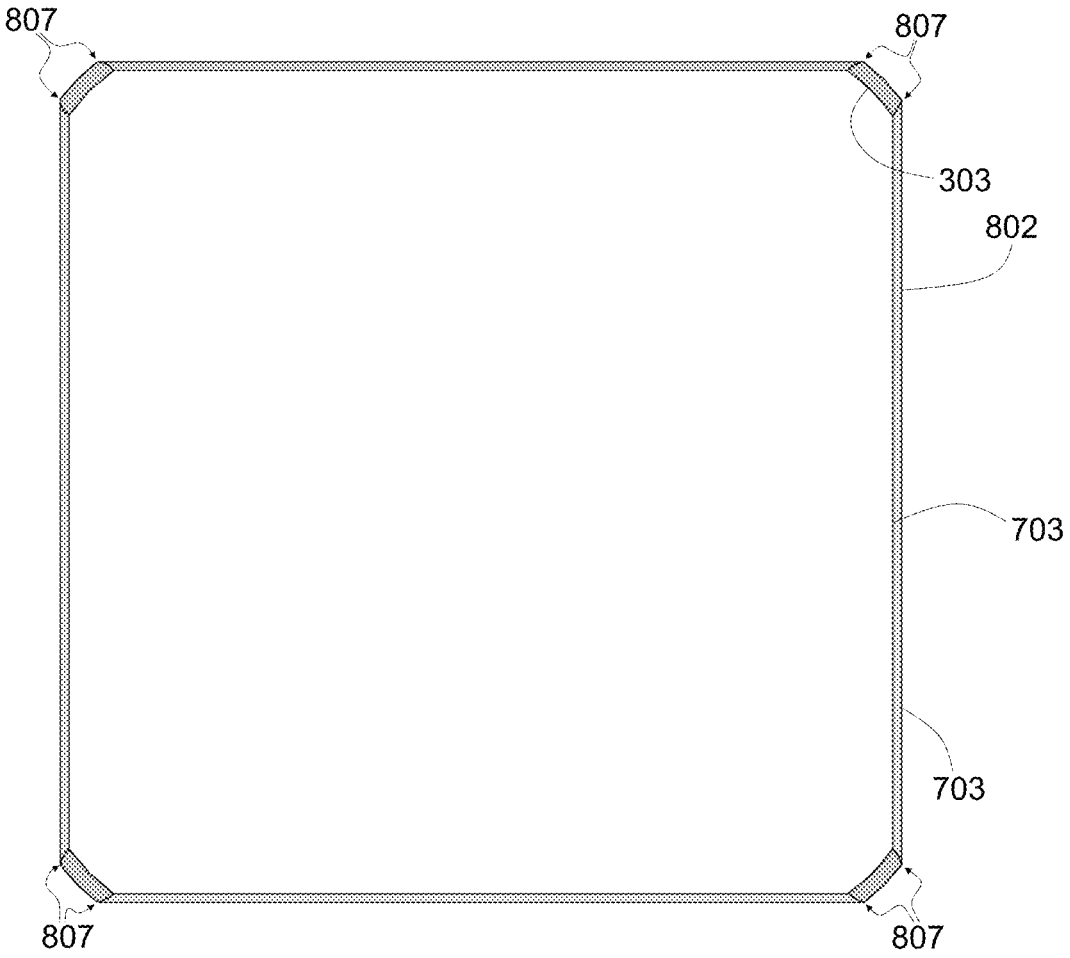
FIG. 20 shows a drawing of the flipped, fused stabilizer and back/sash piece of FIGS. 19A and 19B showing beveled edges.

The structure pictured in FIGS. 19A and 19B is pulled through one of the un-sewn beveled edges. Referring now to FIG. 20, illustrated therein is a drawing of the flipped, fused stabilizer 306 and back/sash piece 708 showing beveled edges 807. The seam allowances and stitching lines 704 are now sandwiched between the two layers. is Fold 802 is forced into the back/sash piece 708 when it is flipped and fused. Fold 802 is intentional and accomplishes two things: it insures that none of the stabilizer 306 will peek out of the sash's 708 edge when a quilt block is made; and it moves the stabilizer 306 away from the fold 802 because the stabilizers' purpose is to prevent wrinkles and folds, so folding over a stabilized piece of fabric is not as easy as folding a piece of fabric with no stabilizer fused to it.

Beveled edges 807 are raw edges at what will be the beveled edges of the quilt block.

Figure 21A:
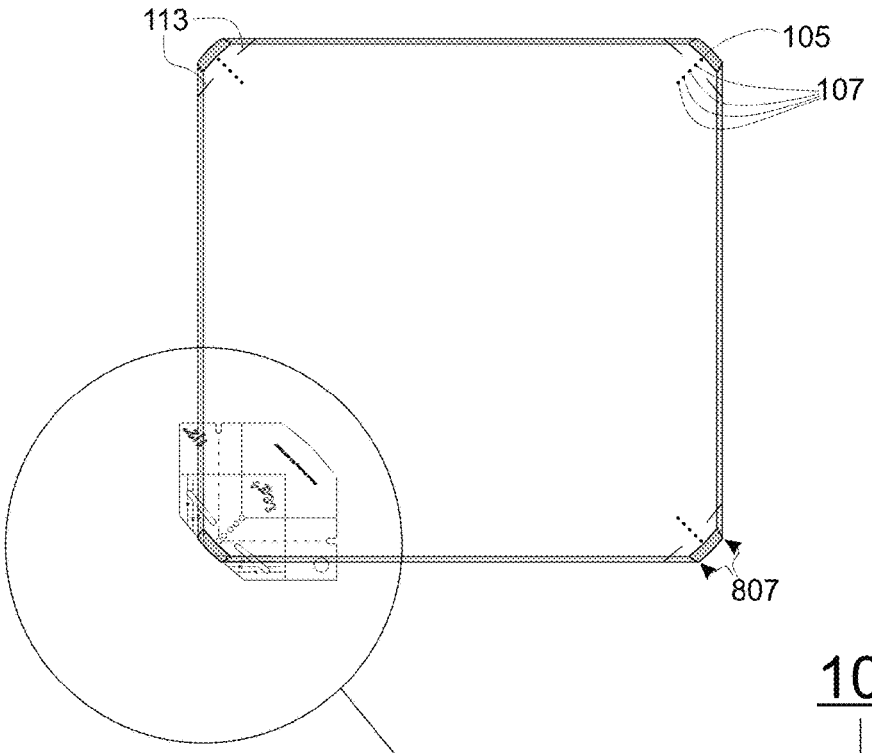
FIGS. 21A and 21B show the installation of joining guide marks using the centering guide portion of the template of FIG. 13A.
Figure 21B:
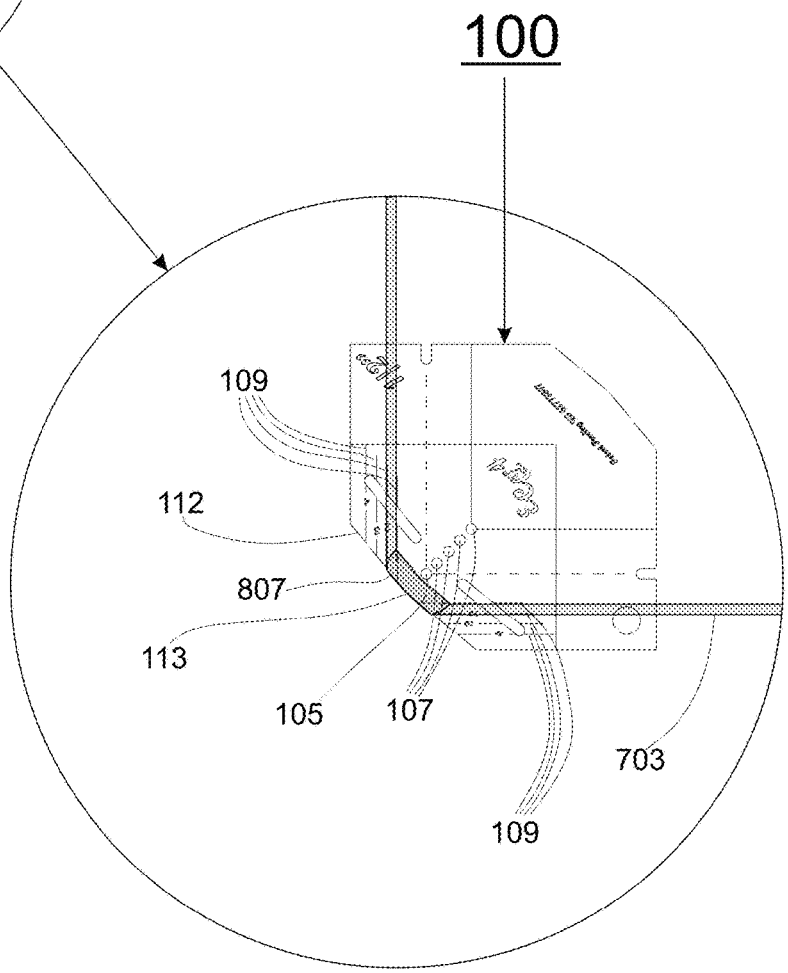

FIGS. 21A and 21B show the installation of joining guide marks using the centering guide portion of the template 1300. Place the template on top of the quilt block and position point 113 so it rests on an unsewn beveled edge. Keeping point 113 positioned as described above, template 1300 is moved so lines 109 (e.g. the centering placement guides) look the same in relationship to the long edges of back/sash on each side of the joining guides (holes 105 plus 107). With the template positioned as described mark the joining guides onto the beveled edge of the quilt back/sash/stabilizer unit. Position and mark all the beveled edges using the preceding steps. It is optional to mark the fold to line (113) when marking the joining guides.

Joining the Quilt Blocks

Figure 22A:
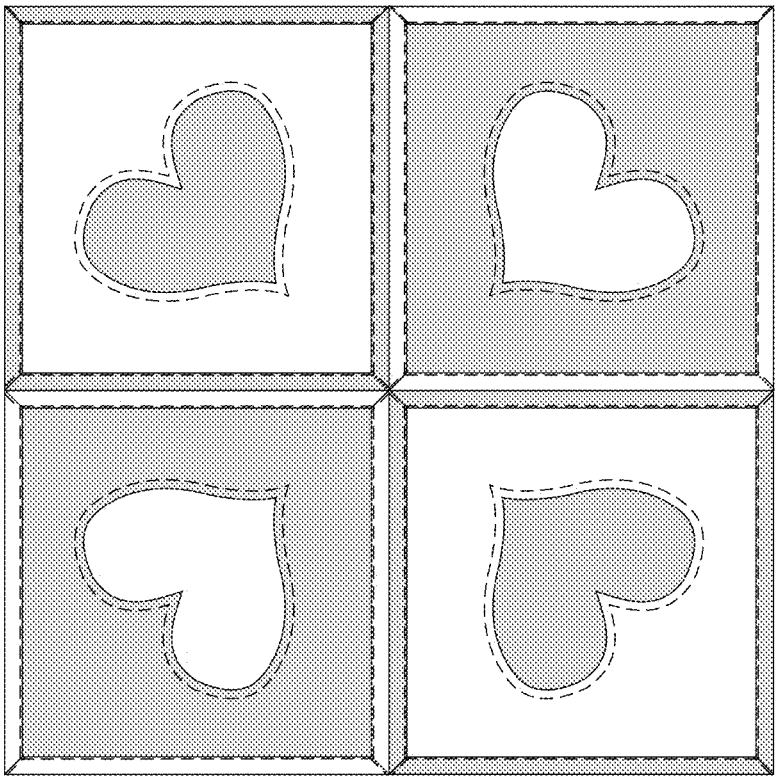
FIG. 22A shows the front of a quilt made using the devices and methods described herein, according to one embodiment.
Figure 22B:
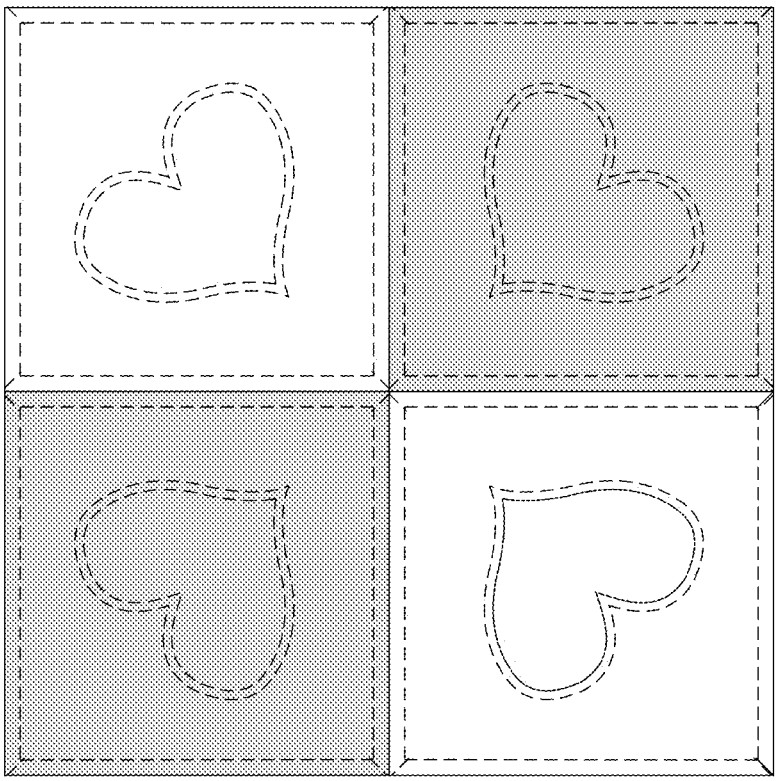
FIG. 22B shows the back of quilt 22B made using the devices and methods described herein.
Figure 23:
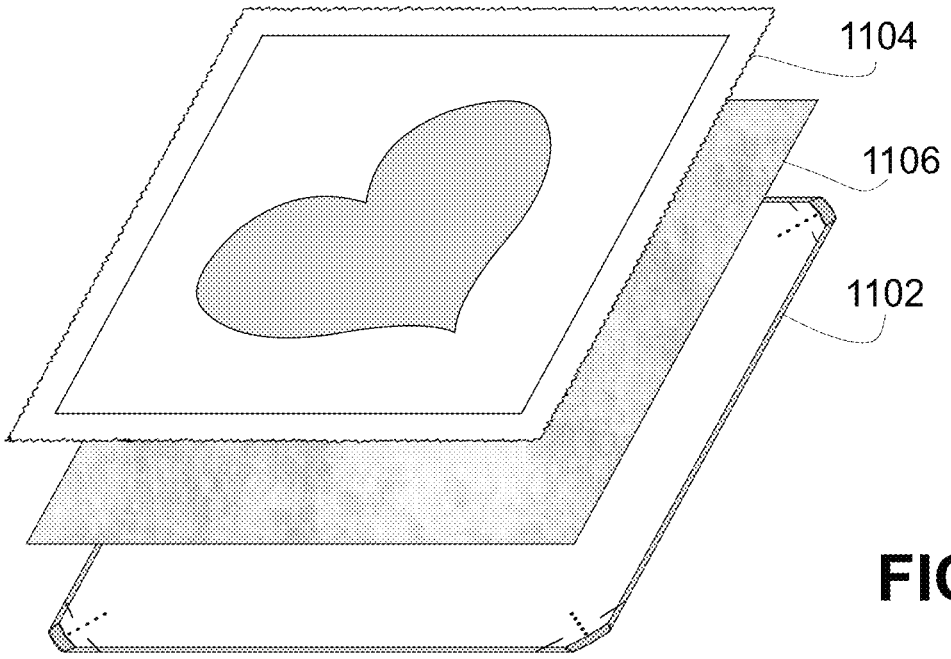
FIG. 23 shows installing batting and feature fabric into the quilt block before joining quilt blocks, according to one embodiment.

Referring now to FIG. 23, at a first step of joining quilt blocks, place a stabilized quilt back/sash 1102, with the stabilized side facing the wrong side of the featured fabric 1104. Place batting 1106, if desired, between the two layers and install any pad stitching. FIG. 23 shows the components of a standard quilt block. Featured fabrics combined with a stabilized back/sash piece are be considered quilt blocks. Quilt blocks typically include a layer of batting, so batting is included into the image but need not be included in the block. The quilts pictured in FIGS. 22A and 22B and FIGS. 30A and 30B are both made with the same kind of quilt blocks pictured in FIG. 23.

Figure 24:
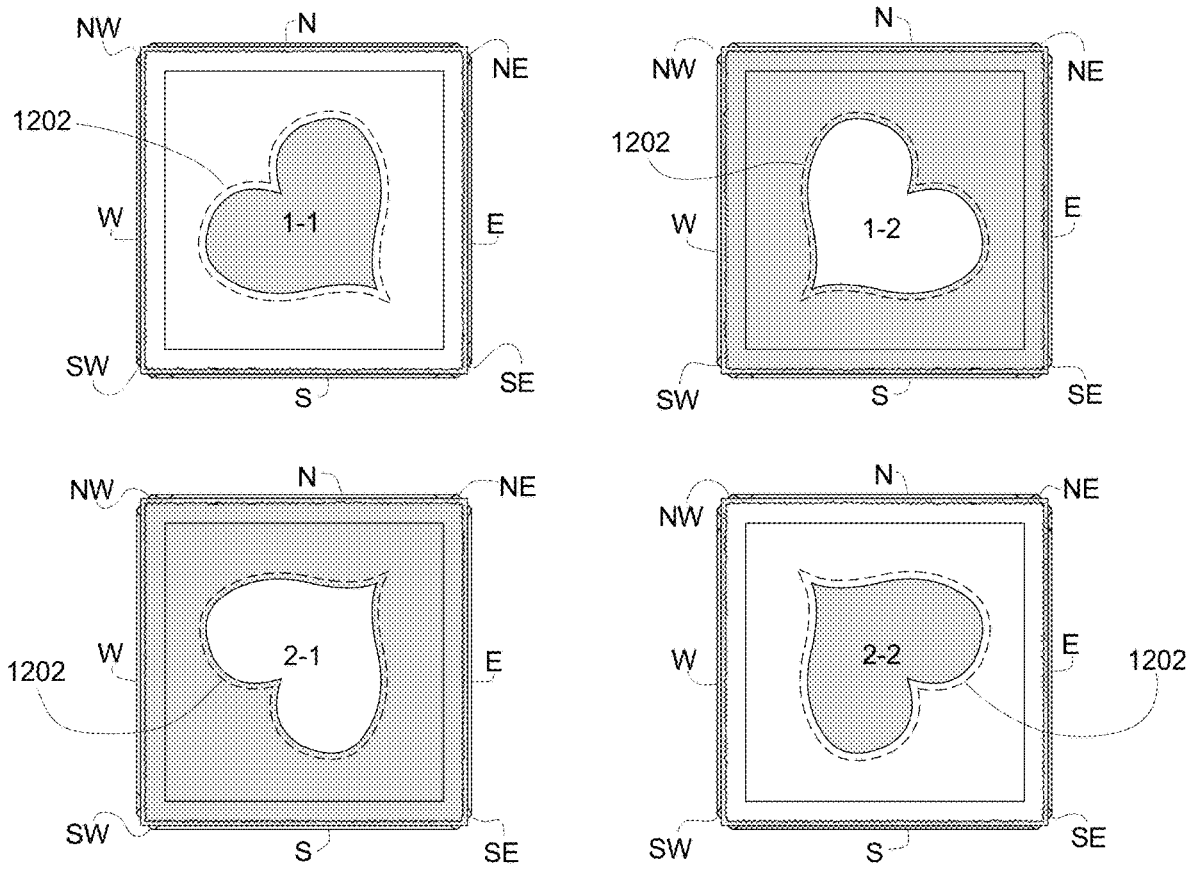
FIG. 24 shows four quilt blocks for constructing the quilt of FIGS. 22A and 22B.

Changing the direction the featured fabric faces when assembling the quilt blocks into a quilt changes the appearance of the finished product. To clarify this, the long edges of each quilt block shown in FIG. 24 are labelled with and identified using a letter. The letters are based on compass readings with "N" simply indicating the top of each quilt block when they are situated as pictured in FIG. 24. The lower edges of the quilt blocks are labeled "S" for south as they are pictured. The long edges on the right sides of quilt blocks are labeled "E" for east. The long edges on the left side of the quilt block are labeled "W" for west.

Similarly, in FIG. 24, for simplicity, each beveled edge is labeled with the two letters of the long edges that meet that beveled edge. The letter labels will be the same regardless of the position of each quilt block during construction. The quilt blocks are named by their row and position where the first number indicates the row and the second number indicates the position in the chain. The designating numbers will be separated by a dash.

To make a quilt like the one shown in FIGS. 22A and 22B, which is characterized by all of the sashes being positioned on the same side of the quilt, first determine the position of each quilt block. (All the drawings show the featured fabric and interfacing folded out of any construction area 1310).

Figure 25:
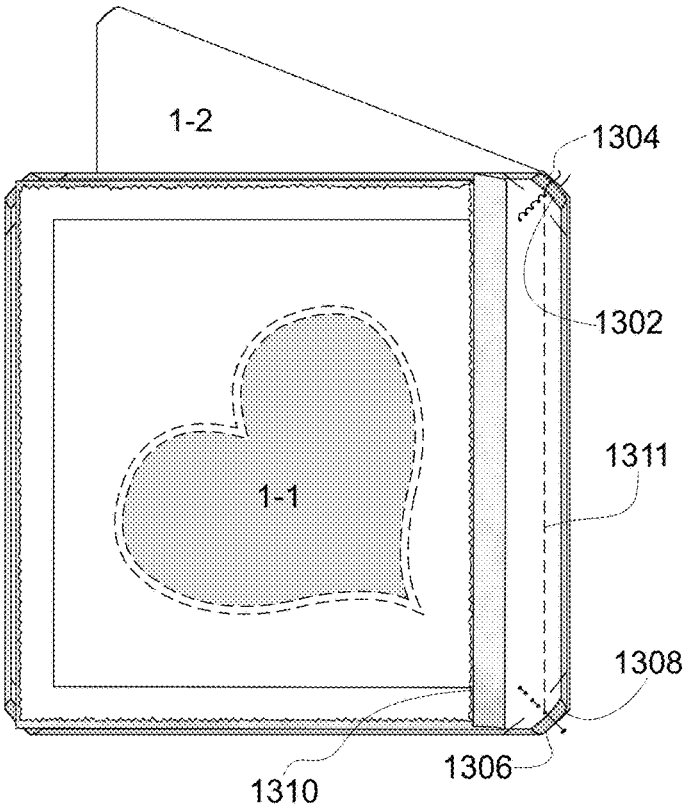
FIG. 25 shows temporarily holding the blocks of row one together along the joining guide mark and joining the quilt blocks to one another by installing a row of stitching from top dot to top dot, according to one embodiment.
Figure 26:
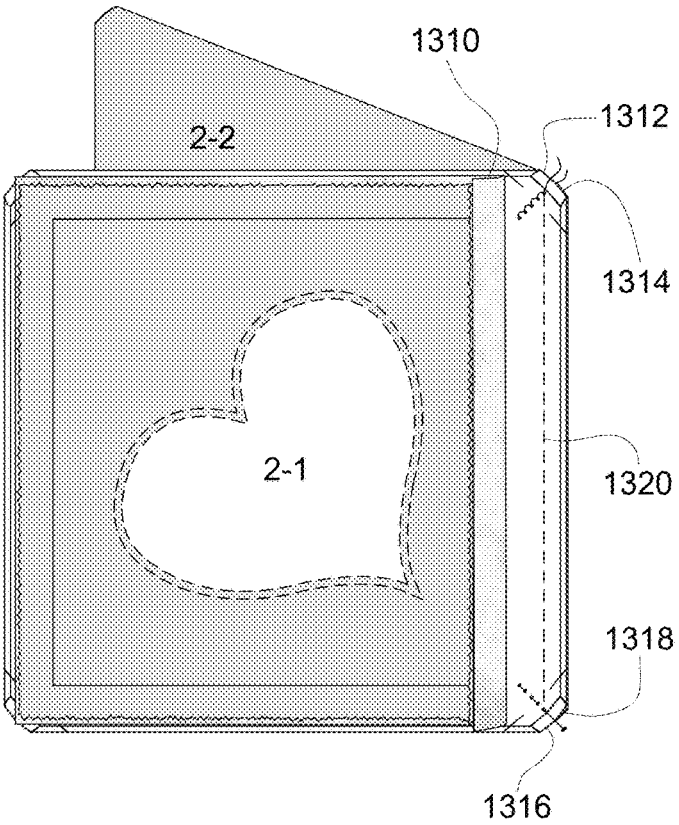
FIG. 26 shows temporarily holding the quilt blocks of row two together along the joining guide mark and joining the quilt blocks to one another by installing a row of stitching from top dot to top dot, according to one embodiment.

With back sides together, position the joining guide marks of template 1300 in the NE beveled edge of block 1-1 (1302) to the joining guide marks in the NW beveled edge of quilt block 1-2 (1304). Temporarily hold the blocks together along the joining guide marks (pinning and basting are shown in FIG. 25). Matching the joining guide marks, temporarily hold the quilt blocks together at the SE beveled edge of quit block 1-1 (1306) and the SW beveled edge of quilt block 1-2 (1308). Join the quilt blocks to one another by installing a stitching line from top dot to top dot 1311 (see FIG. 25). With back sides together, temporarily hold the quilt block 2-1's NE beveled edge 1312 to quilt block 2-2's NW beveled edge 1314 matching joining guide marks. Match and temporarily hold the joining guide marks in the SE beveled edge of quilt block 2-1 (1316) to the joining guide marks in the SW beveled edge of quilt block 2-2 (1318). Join the quilt blocks to one another by installing a row of stitching from top dot to top dot 1320 (see FIG. 26).

Figure 27A:
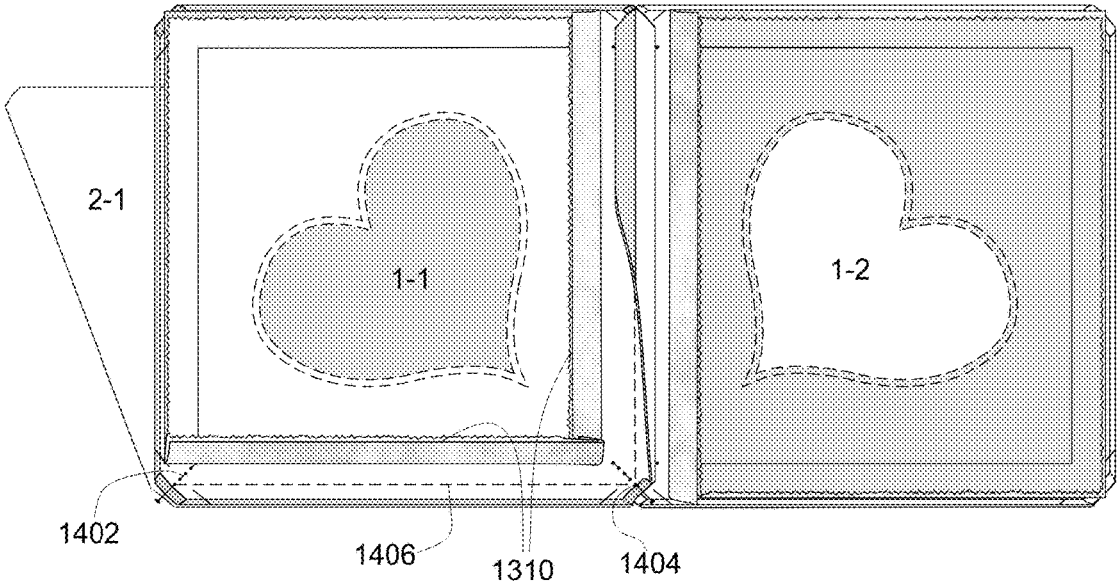
FIG. 27A shows removing any temporary stays and opening the quilt blocks and, with back sides together, aligning the joining guide marks in the beveled edge of one of the quilt blocks in row 1 to the joining guide marks in the beveled edge of a neighboring quilt block in row 2, temporarily holding the pieces together along the joining guide marks and joining rows of quilt blocks together by stitching the first block in each row from top dot to top dot, according to one embodiment.

Remove any temporary stays and open the quilt blocks as shown in FIG. 27A. With back sides together, align the joining guide marks in the SW beveled edge of quilt block 1-1 to the joining guide marks in the NW beveled edge of quilt block 2-1 and temporarily hold the pieces together along the joining guide marks (1402). Align and temporarily join the SE joining guide marks in the beveled edge of quilt block 1-1 to the joining guide marks installed in the NE beveled edge of quilt block 2-1 (1404). Sew quilt block 1-1 to quilt block 2-1 between temporary stays from top dot to top dot 1406.

Figure 27B:
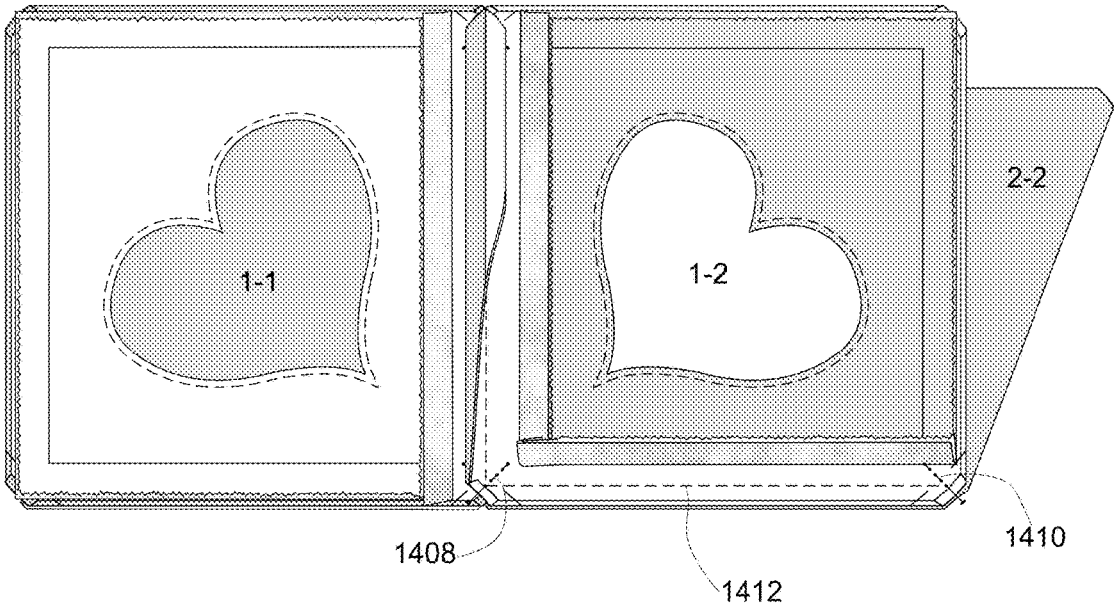
FIG. 27B shows the second quilt block of row 1 being sewn to the second quilt block of row 2 with back sides together, aligning the joining guide marks in the beveled edge of the second quilt block in row 1 to the joining guide marks in the beveled edge of a neighboring quilt block in row 2, temporarily holding the pieces together along the joining guide marks and joining rows of quilt blocks together by stitching the first block in each row from top dot to top dot, according to one embodiment.

Turning to FIG. 27B, with back sides together, align the joining guide marks in the SW beveled edge of quilt block 1-2 to the joining guide marks in the NW beveled edge of quilt block 2-2 (1408) and temporarily hold the pieces together along the joining guide marks. Align and temporarily join the SE joining guide marks in the beveled edge of quilt block 1-2 to the joining guide marks installed in the NE beveled edge of quilt block 2-2 (1410). Sew quilt block 1-2 to quilt block 2-2 between temporary stays from top dot to top dot 1412.

Remove all temporary stitches. Trim the featured fabric and any batting so it measures the initial geometry plus a border equaling the sash depth minus about 0.125". Sew each beveled edge closed which completes the sash, Sew the long edges in place in order to conceal any raw edges of the featured fabric and the quilt is complete.

Figure 28A:
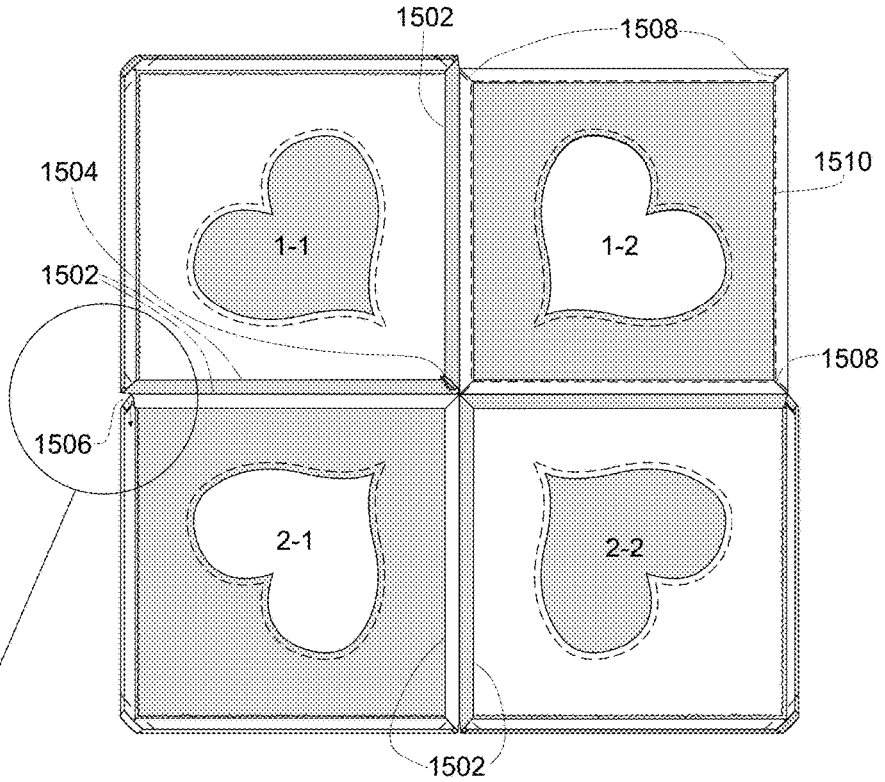
FIGS. 28A and 28B show completing a quilt by removing all the temporary stays, unfolding the quilt blocks and sewing the sashes in place concealing the raw edges of the featured fabric and batting, according to one embodiment.
Figure 28B:
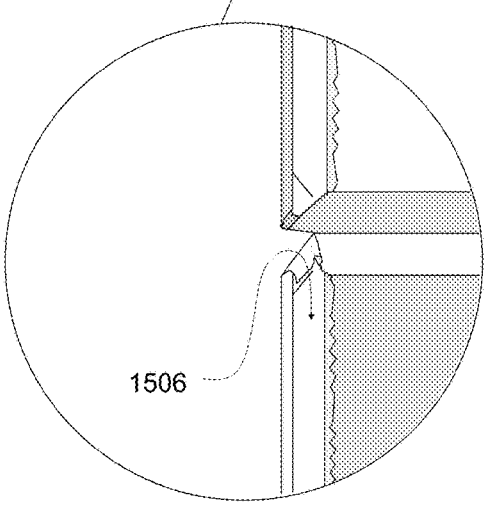

FIGS. 28A and 28B show quilt blocks positioned to make a quilt like the one illustrated in FIGS. 22A and 22B. Therein, 1502 shows the sash portion of the stabilized sash/back being folded to the front in order to frame the featured fabric and cover any batting and raw edges. Beveled edge 1504 is shown when the sashes are folded toward the center of the quilt block. They have not been turned under so the raw edges are poking out. Fold 1506 shows the raw edges of the beveled edge folded toward the "fold to" line as one method of finishing the beveled edges. Top stiches 1508 are installed through all layers of the quilt as on possible method of holding the beveled edges closed.

Figure 29:
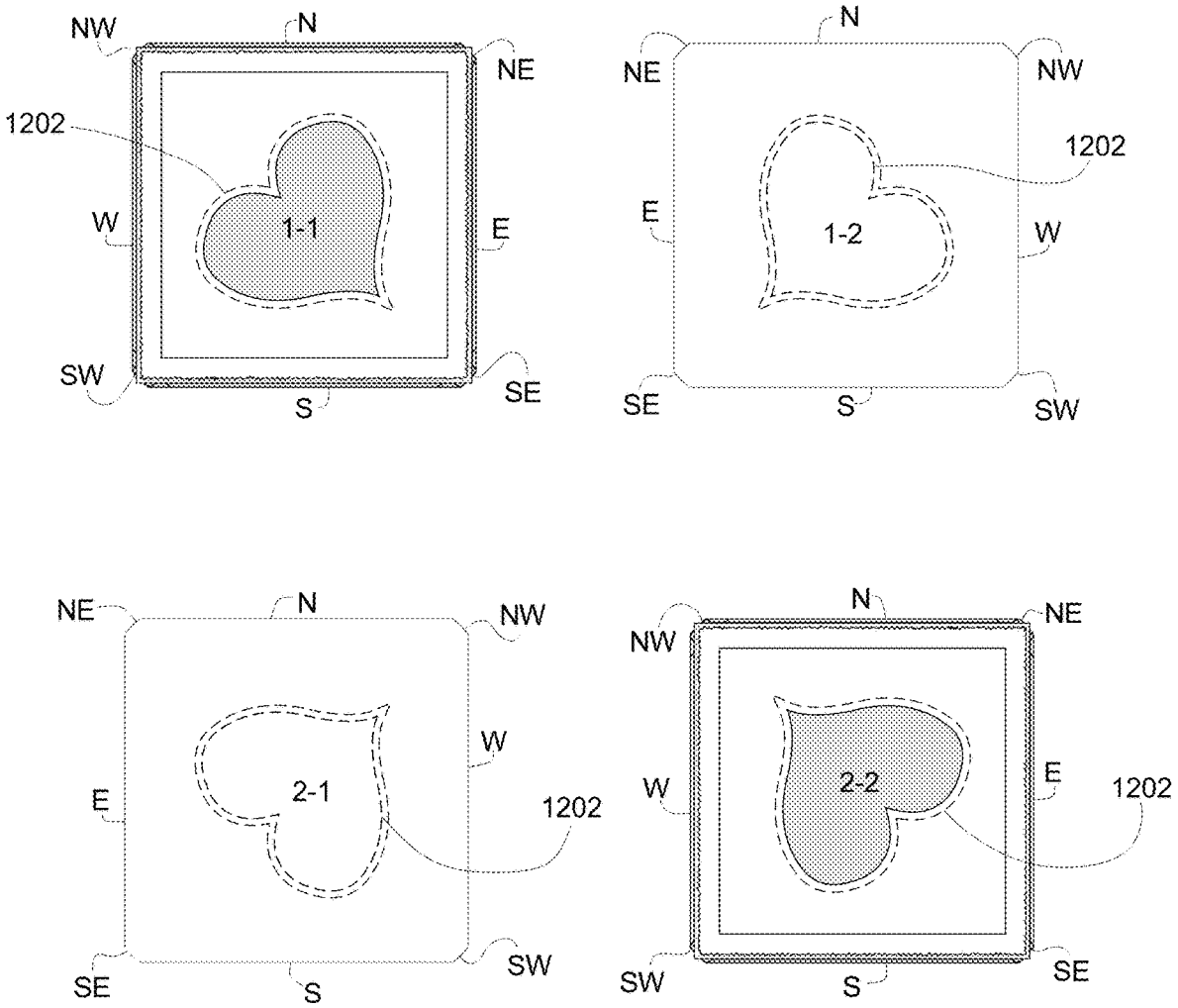
FIG. 29 shows that the same quilt blocks used to make the quilt pictured in FIGS. 22A and 22B can be used to make the reversible quilt shown in FIGS. 30A and 30B by alternating the featured fabric face up or face down.

FIG. 29 shows a quilt with sashes alternating between sides of the quilt. In this example, the quilt requires less precision that the quilt pictured in FIG. 10 and is reversible. Starting with the same 4 blocks as the quilt in FIGS. 22A and 22B, select every other block in the row and flip the block along its north-south axis so the feature fabric is positioned facing the opposite direction as the quilt blocks bordering it (e.g. since quilt block 1-1 is feature fabric up, blocks 1-2 and 2-1 must be feature fabric down). The letter labels flipped as well as the quilt blocks.

Figure 30A:
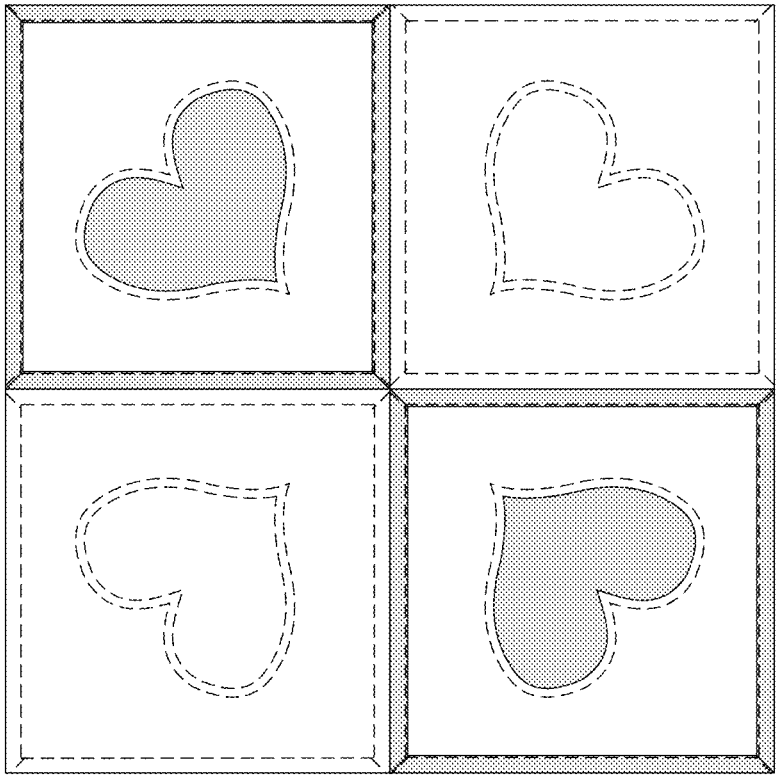
FIGS. 30A and 30B show a front view and a back view, respectively, of a quilt with sashes alternating between sides of the quilt made using the devices and methods described herein, according to another embodiment.
Figure 30B:
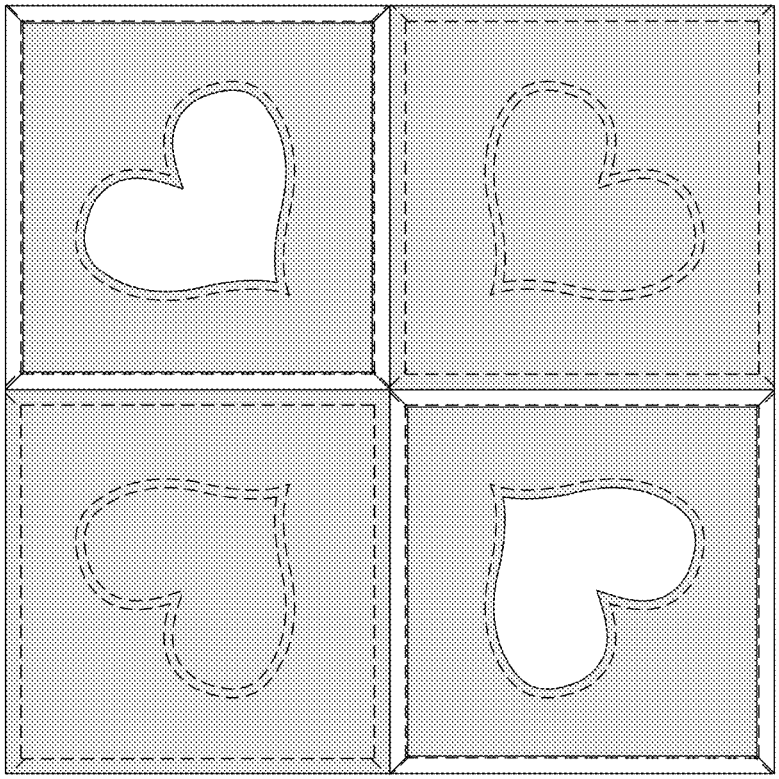
Figure 31A:
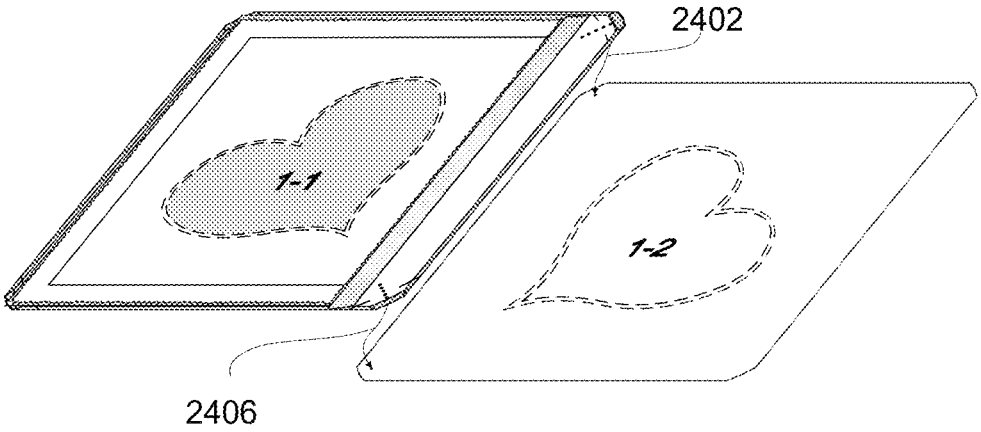
FIGS. 31A and 31B show quilt blocks being positioned to be joined to one another to make the quilt of FIGS. 30A and 30B.
Figure 31B:
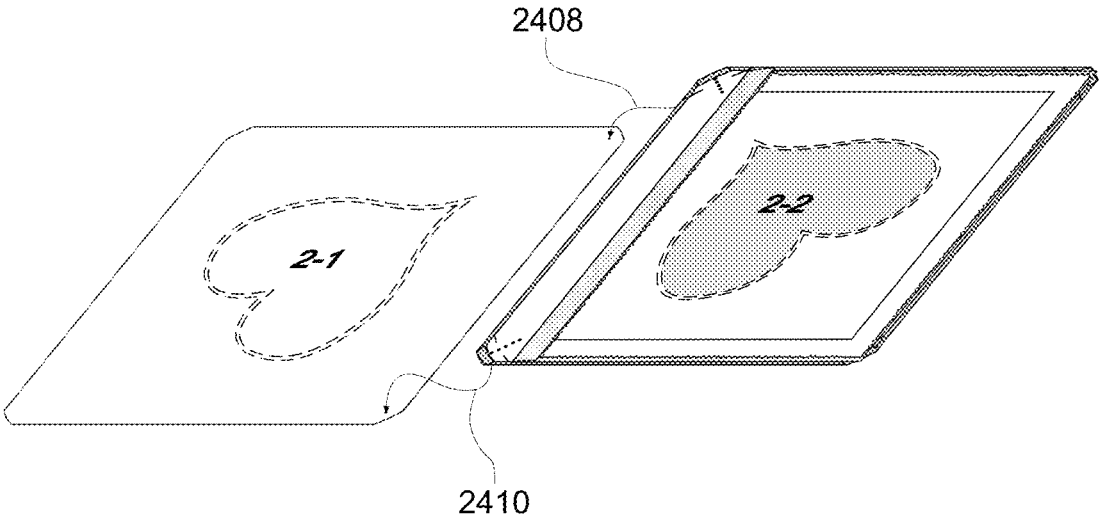
Figure 32A:
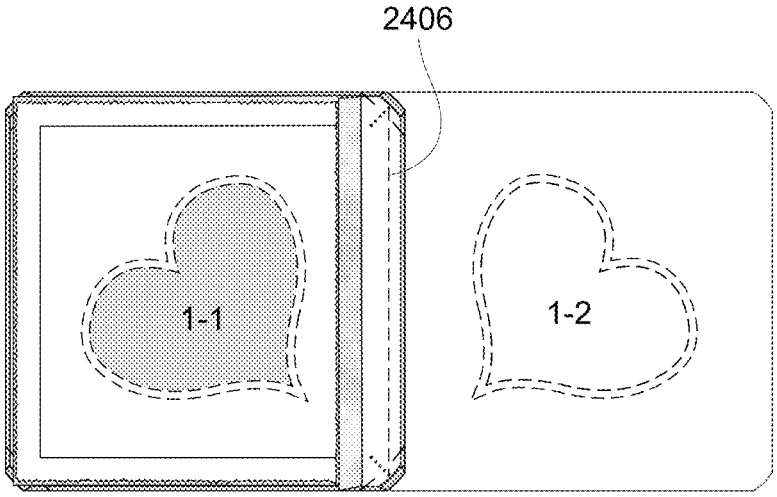
FIG. 32A shows positioning quilt block 1-1 so it overlaps quilt block 1-2 with back sides together, matching top dots, and installing a row of stitching between the top dots in the matched beveled edges, according to one embodiment.

FIGS. 31A and 31B show the quilt blocks being positioned to be joined to one another to make a quilt like the one drawn in FIGS. 30A and 30B. The only mark required for this particular quilt are the top dots. The method for assembling these blocks is described below, First, position a quilt block on top of the next quilt block in the row (1-1 is placed on top of 1-2) with their backs together. Then, line up the quilt blocks by matching top dots on the NE beveled edge of 1-1 to the top dot in the NE beveled edge of quilt block 1-2 (2402) (e.g. the designating letter switched sides when the quilt block was flipped). Then line up the top dots in the SE beveled edges of the quilt blocks 1-1 and 1-2 (2304). With the quilt blocks positioned as described, temporarily hold the quilt blocks together at their top dots. Then, install a row of stitching between the top dots in the NE beveled edges and the SE beveled edges of quilt blocks 1-1- and 1-2 (2406) as shown in FIG. 32A.

Figure 32B:
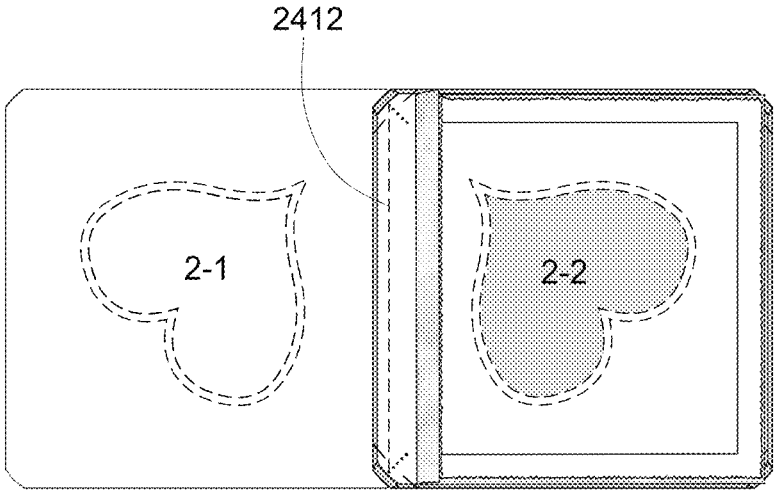
FIG. 32B shows positioning quilt block 2-2 so it overlaps quilt block 2-1 with back sides together, matching top dots, and installing a row of stitching between the top dots in the matched beveled edges, according to one embodiment.

Position quilt block 2-2 to quilt block 2-1 so their edges overlap (as shown in FIG. 32B). With their backs facing, line up the top dots in the NW beveled edges of both quilt blocks and temporarily hold them in place 2408. Match the top dots in the SW beveled edges of quilt blocks 2-1 and 2-2 (2410).

Then, temporally hold the quilt blocks together at the top dots and install a row of stitching between the top dots in the NE beveled edges and the SE beveled edges of quilt blocks 1-1- and 1-2 (2412). After installing as many quilt blocks as desired in a row, join the rows together. In this example, the quilt block 1-1 is joined to quilt block 2-1 (see FIG. 33A), Match the quilt blocks back sides together at the top dots. This causes quilt block 1-1 to overlap quilt block 2-1. The SW top dot in the beveled edge of the quilt block in the upper row (1-1) is matched to the top dot in beveled edge NE of the block in the row below it (2-1), The top dot in the SE beveled edge of quilt block 1-1 is matched to the top dot in the NW beveled edge of 2-1. With the quilt blocks temporally held in this position, move all the beveled edges of quilt squares away from the intended stitching lines and sew from between the temporary stays from top dot to top dot 2502. Remove the temporary stays. Continue joining quilt blocks in this fashion until the two rows are joined together 2602.

Figure 33:
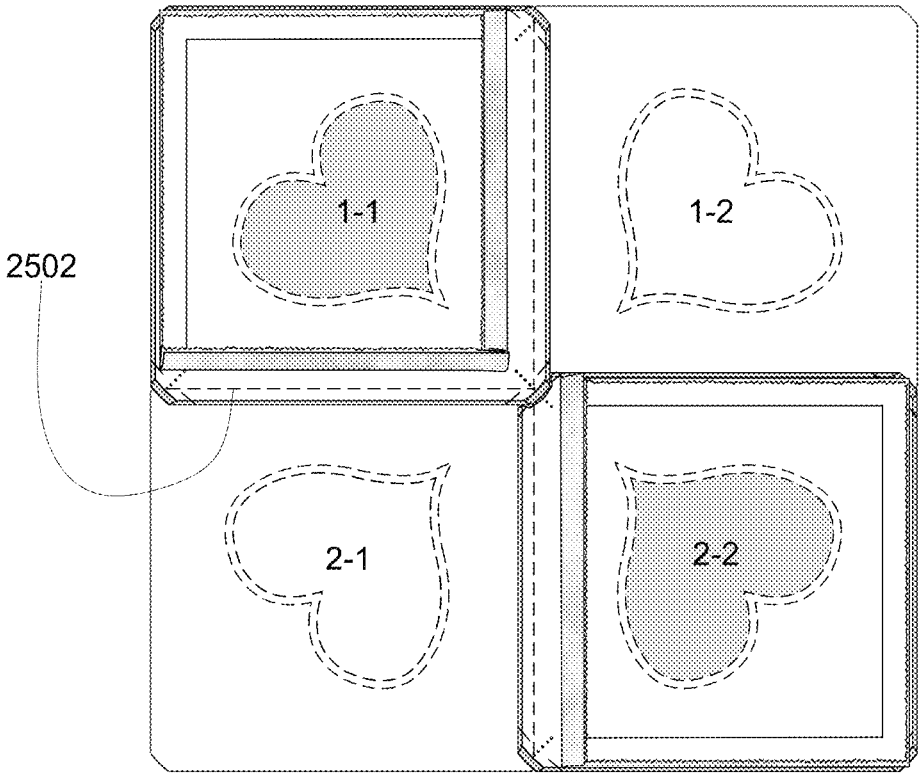
FIG. 33 shows positioning quilt block 1-1 so it overlaps quilt block 2-1, matching top dots at the beveled edges, and installing a row of stitches between the top dots, according to one embodiment.

FIG. 33 shows positioning quilt block 1-1 so it overlaps quilt block 2-1, matching top dots at the beveled edges, and installing a row of stitches between the top dots, according to one embodiment.

Figure 34:
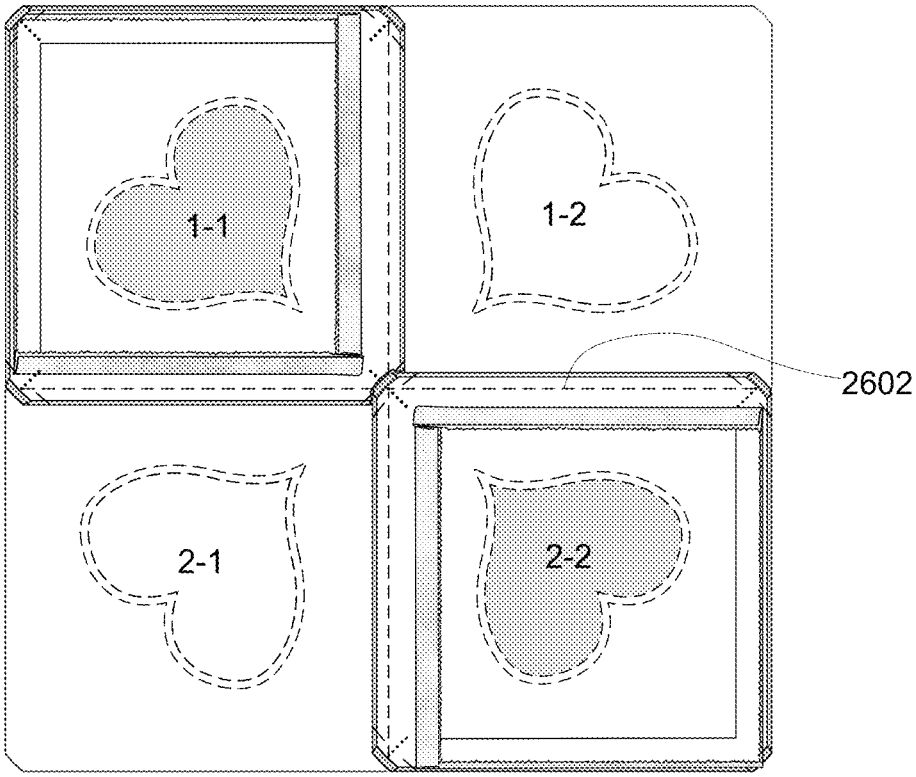
FIG. 34 shows positioning quilt block 2-2 so it overlaps quilt block 1-2, matching top dots at the beveled edges, and installing a row of stitches between the top dots, according to one embodiment.

FIG. 34 shows positioning quilt block 2-2 so it overlaps quilt block 1-2, matching top dots at the beveled edges, and installing a row of stitches between the top dots, according to one embodiment.

Trim the featured fabric and any batting so it measures the initial geometry plus a border equaling of the sash depth minus about 0.125". Stitch the beveled edges closed. Sew around the sash holding it to the featured fabric and enclosing all raw edges.

Embodiments described herein should not be construed as limiting, but rather that additions and modifications to what is expressly described herein. Features of the various embodiments described herein are not mutually exclusive and can exist in various combinations and permutations, even if such combinations or permutations are not made express herein, without departing from the spirit and scope of the invention.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A device for forming a lined quilt back of a quilt block, the lined quilt back having a back piece and a stabilizer, the back piece and the stabilizer each having one or more beveled edges, the device comprising:

a flat body having a front planar surface and a rear planar surface that contacts a fabric when in use, the flat body including:

a back/sash template for measuring and cutting a back piece of the quilt back, the back/sash template having:

a first pair of line segments meeting at a first initial angle, the first initial angle being equal to an angle of each corner of the back piece;

a pair of back/sash cutting edges each formed by an outer edge of the device; and a pair of back/sash beveled angle cutting edges meeting to form a first beveled angle, the first beveled angle differing from the first initial angle to provide the back piece with the one or more beveled edges; and a stabilizer template for measuring and cutting the stabilizer piece of each quilt block, the stabilizer template having:

a second pair of line segments meeting at a second initial angle, the second initial angle being equal to the angle of each corner of the stabilizer;

a pair of stabilizer cutting edges each formed by other outer edges of the device, the stabilizer cutting edges and the back/sash cutting edges being positioned on opposite sides of the device; and a pair of stabilizer beveled angle cutting edges meeting to form a second beveled angle, the second beveled angle differing from the second initial angle to provide the stabilizer with the one or more beveled edges;

wherein, the first initial angle, the first beveled angle, the second initial angle and the second beveled angle are aligned with a centering guide along a center axis of the device, and wherein a first distance between the first initial angle and the first beveled angle is different than a second distance between the second initial angle and the second beveled angle.

2. The device of claim 1 further comprising the centering guide for indicating where quilt blocks in different rows of the quilt will align, the centering guide including a joining guide positioned along a center axis of the device.

3. The device of claim 2, wherein the joining guide includes two or more apertures of equal size.

4. The device of claim 3, wherein the apertures are spaced apart from each other by a distance in a range of about 0.02 inches to about 0.5 inches apart.

5. The device of claim 4, wherein the two or more apertures include a top dot for installing marks indicating the beginning and end of stitch lines when joining two or more of the quilt blocks together.

6. The device of claim 5, wherein the top dot is positioned on the device to align quilt blocks with one another.

7. The device of claim 2, wherein the joining guide includes five apertures aligned along the center axis of the device.

8. The device of claim 2, wherein the centering guide includes centering placement guides positioned on either side of the joining guide.

9. The device of claim 8, wherein the centering placement guides include a first group of centering placement guides and a second group of centering placement guides, the first group and the second group being positioned on opposite sides of a center axis of the device.

10. The device of claim 9, wherein each centering placement guide of the first group of centering placement guides has a corresponding centering placement guide in the second group of centering placement guides.

11. The device of claim 9, wherein the first group of centering placement guides includes a plurality of line segments, each line segment being positioned in a range of about 0.02 inches to about 0.75 inches apart from a neighboring line segment.

12. The device of claim 9, wherein the second group of centering placement guides includes a plurality of line segments, each line segment being positioned in a range of about 0.02 inches to about 0.75 inches apart from a neighboring line segment.

13. The device of claim 2, wherein the centering guide is positioned towards the back/sash beveled angle cutting edge.

14. The device of claim 1, further comprising stitch placement guides that indicate where stitches will be placed to join the quilt blocks to another quilt block.

15. The device of claim 14, wherein the stitch placement guides are dashed lines.

16. The device of claim 1, further comprising channels to provide for marking stitching lines on the fabric.

17. The device of claim 1, wherein the quilt block has an equiangular shape.

* * * * *